US011815093B2

(12) United States Patent
Lee et al.

(10) Patent No.: US 11,815,093 B2
(45) Date of Patent: Nov. 14, 2023

(54) SCROLL COMPRESSOR AND AIR CONDITIONER HAVING THE SAME

(71) Applicant: LG Electronics Inc., Seoul (KR)

(72) Inventors: Jaeha Lee, Seoul (KR); Yongkyu Choi, Seoul (KR); Minho Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 73 days.

(21) Appl. No.: 17/506,348

(22) Filed: Oct. 20, 2021

(65) Prior Publication Data

US 2022/0178371 A1 Jun. 9, 2022

(30) Foreign Application Priority Data

Dec. 3, 2020 (KR) ..... 10-2020-0167781

(51) Int. Cl.

| | |
|---|---|
| ***F04C 18/02*** | (2006.01) |
| ***F04C 29/02*** | (2006.01) |
| ***F04C 29/06*** | (2006.01) |
| ***F04C 23/00*** | (2006.01) |

(52) U.S. Cl.

CPC ..... *F04C 18/0215* (2013.01); *F04C 23/008* (2013.01); *F04C 29/026* (2013.01); *F04C 29/028* (2013.01); *F04C 29/065* (2013.01); *F04C 2240/30* (2013.01); *F04C 2240/60* (2013.01); *F04C 2250/20* (2013.01); *F04C 2250/30* (2013.01)

(58) Field of Classification Search

CPC .. F04C 18/0215; F04C 23/008; F04C 29/026; F04C 29/028; F04C 29/065

See application file for complete search history.

(56) References Cited

U.S. PATENT DOCUMENTS 5,709,090 A * 1/1998 Endo ..... F25B 9/006 62/502
2004/0179967 A1 9/2004 Morozumi et al.
2020/0095994 A1 3/2020 Kim et al.

FOREIGN PATENT DOCUMENTS

| | | |
|---|---|---|
| CN | 109578285 | 4/2019 |
| EP | 2479436 | 2/2016 |
| JP | 1992234591 | 8/1992 |

(Continued)

OTHER PUBLICATIONS

English translation of JP-H80303364 by PE2E Feb. 17, 2022.*

(Continued)

*Primary Examiner* — Deming Wan

(74) *Attorney, Agent, or Firm* — Fish & Richardson P.C.

(57) ABSTRACT

A scroll compressor includes a motor portion fixed in an inner space of a casing, a compression portion fixed to the inner space of the casing at one side of the motor portion in an axial direction, a rotation shaft to transmit a driving force from the motor portion to the compression portion, and a flow path guide provided in a discharge space between the motor portion and the compression portion and provided with a guide outlet communicating with the discharge space and opened in a direction toward the rotation shaft. Therefore, most of refrigerant discharged to the discharge space through the flow path guide is moved toward an air gap to enhance an oil separation effect, and thus a normal operation point of the air conditioner can be accelerated.

18 Claims, 20 Drawing Sheets

(56) References Cited

FOREIGN PATENT DOCUMENTS

| | | | | | |
|---|---|---|---|---|---|
| JP | H0679843 | | | 3/1994 | |
| JP | 1996303366 | | | 11/1996 | |
| JP | H08303364 | A | * | 11/1996 | ..... F04C 18/0215 |
| JP | H10198824 | | | 7/1998 | |
| KR | 20110054818 | | | 5/2011 | |
| KR | 20160020191 | | | 2/2016 | |
| KR | 20180115174 | | | 10/2018 | |
| KR | 20180116174 | | | 10/2018 | |
| WO | WO-2010103871 | A1 | * | 9/2010 | ..... F04C 23/008 |
| WO | WO2018130134 | | | 7/2018 | |

OTHER PUBLICATIONS

English translation of WO-2010103871 by PE2E Feb. 17, 2023.*
Office Action in Korean Appln. No. 10-2020-0167781, dated Jan. 5, 2022, 17 pages (with English translation).
Extended European Search Report in European Appln. No. 21205523.0, dated May 3, 2022, 8 pages.

* cited by examiner

SCROLL COMPRESSOR AND AIR CONDITIONER HAVING THE SAME

CROSS-REFERENCE TO RELATED APPLICATION

Pursuant to 35 U.S.C. § 119(a), this application claims the benefit of the earlier filing date and the right of priority to Korean Patent Application No. 10-2020-0167781, filed on Dec. 3, 2020, the contents of which is incorporated by reference herein in its entirety.

TECHNICAL FIELD

The present disclosure relates to a scroll compressor and an air conditioner having the same, and more particularly, to a high-pressure and lower compression-type scroll compressor, and an air conditioner applying the same.

BACKGROUND

In general, a compressor is a machine used for generating high pressure or transmitting a high-pressure fluid, and a compressor applied to a refrigeration cycle such as a refrigerator or an air conditioner performs a role of compressing refrigerant gas and transmitting the compressed refrigerant to a condenser. And, to a large air conditioner such as a system air conditioner installed in a building, a scroll compressor is mainly applied.

The scroll compressor has a fixed scroll fixed in an inner space of a casing, and is configured such that an orbiting scroll is engaged with the fixed scroll to perform an orbiting motion. Accordingly, a series of processes of sucking, compressing, and discharging refrigerant gas into a compression space is repeated by a compression chamber sequentially formed between a fixed wrap of the fixed scroll and an orbiting wrap of the orbiting scroll.

Recently, there is provided a high-pressure and lower compression-type compressor in which a compression portion including a fixed scroll and an orbiting scroll and disposed under a motor portion that transmits a driving force to rotate the orbiting scroll is configured to directly receive refrigerant gas, compress the refrigerant gas, and provide the compressed refrigerant gas to an upper space of a casing to thereby discharge the refrigerant gas.

In such a lower compression-type compressor, refrigerant discharged into an inner space of the casing moves to a refrigerant discharge pipe disposed at an upper portion of the casing, whereas oil is recovered to a storage space provided under the compression portion. Here, oil may be mixed in the refrigerant to be discharged outwardly of the compressor or may be pushed by a pressure of the refrigerant to stay above the motor portion.

Further, in the lower compression-type compressor, oil may be mixed in the refrigerant discharged from the compression portion, then pass through the motor portion (or driving motor) to move upwards, and at the same time, oil staying above the motor portion may pass through the motor portion to move downwards. Accordingly, the oil moving downwards may be mixed in the refrigerant discharged from the compression portion to be discharged outwardly of the compressor, or may be blocked from moving down under the motor portion due to a high-pressure refrigerant moving upwards. Then, as an amount of oil recovered to the storage space rapidly decreases, an amount of oil supplied to the compression portion decreases, causing friction loss or abrasion of the compression portion.

Some compressors use a technology for partitioning a path through which refrigerant is discharged and a path through which oil is discharged by placing a flow path guide between the motor portion and the compression portion. However, in the flow path guide disclosed in such compressors, an outlet of the flow path guide is opened toward an inner passage formed between a stator core and a stator coil and opened toward an air gap passage formed in an air gap between a stator and a rotor. In particular, as the inner passage of the stator has a wider cross-sectional area than the air gap passage, refrigerant mainly moves upwardly of the motor portion through the inner passage of the stator. This is advantageous in that the refrigerant moves quickly to an upper space of the casing, but since the refrigerant simply passes through a fixed passage to move to the upper space, this is not effective in separating liquid refrigerant or oil in the upper space (hereinafter referred to as an oil separation or oil separation effect). In addition, since a discharge space formed between the motor portion and the compression portion serves as a kind of a passage, the oil separation in the discharge space is not effectively performed.

Some compressors include a guide installed at an upper side of a compression portion to guide refrigerant discharged from a compression chamber toward a motor portion. An outlet of the guide is located closer to a rotation shaft than an air gap. Accordingly, a part of the refrigerant discharged to a discharge space between the motor portion and the compression portion through the guide may be first guided toward the air gap. Then, an amount of refrigerant induced into the air gap is increased compared to other compressors, so that the oil separation effect in the upper space may be improved to some extent. In addition, in some compressors, a balance weight is provided between the motor portion and the guide, so that refrigerant discharged from the outlet of the guide to the discharge space is brought into contact with the balance weight while moving to an air gap passage or an inner passage of the motor portion. The oil separation effect in the discharge space may also be expected to some extent.

However, in the related art compressors as described above, the oil separation effect in the inner space of the casing as a whole is low, and accordingly, a concentration of oil is lowered and this may cause friction loss or abrasion. In other words, in an initial start-up of the compressor, an internal temperature of the casing is low, so that liquid refrigerant remains in a state where it is not vaporized, and the liquid refrigerant is mixed in oil in the storage space, thereby reducing a concentration of the oil. When such a low-concentration oil is supplied to a bearing surface or the compression portion, friction loss on the bearing surface or compression portion may be increased, and the bearing surface or the compression portion may be worn and damaged, or a lifespan thereof may be shortened. Such a phenomenon may occur severely in a case of a low-temperature environment or in a case of a large compressor applied to an air conditioning system in a building. In particular, in the case of the large compressor, the above-described problem may occur in more serious way because a large amount of liquid refrigerant is introduced at a beginning of operation due to its wider inner space but a time for reaching an oil superheat, which is a condition for liquid refrigerant to vaporize, is delayed.

In addition, in some compressors, as the balance weight and the guide are arranged in an axial direction and the outlet of the guide faces the motor portion in the axial direction, refrigerant discharged to a space between the motor portion and the compression portion through the guide may be quickly guided to the inner passage or the air gap of the motor portion. Accordingly, the refrigerant discharged into the space between the motor portion and the compression portion passes through the motor portion without being sufficiently stirred by the balance weight, thereby weakening the oil separation effect. In addition, as the balance weight and the guide are arranged in the axial direction, a gap between the motor portion and the compression portion may increase to thereby increase a height of the compressor.

In addition, since the related art scroll compressor presented above fails to smoothly and quickly separate liquid refrigerant or oil in the compressor in the initial start-up, a time point of switching to a normal operation may be delayed. For this reason, when the related art scroll compressor is applied to an air conditioner, cooling or heating (especially heating) may not be provided when a user needs it.

SUMMARY

Particular implementations of the present disclosure provide a scroll compressor that includes a casing defining an inner space, a motor, a compression portion, a rotation shaft, and a flow path guide. The motor includes (i) a stator that is fixed in the inner space of the casing and defines a first recovery passage extending between opposite ends of the stator in an axial direction, and (ii) a rotor that is configured to rotate relative to the stator, wherein a gap is defined between the rotor and the stator. The compression portion is fixed in the inner space of the casing and including a plurality of scrolls. The compression portion defines a discharge passage that is configured to discharge refrigerant compressed by a motion of the plurality of scrolls relative to the inner space of the casing. The discharge passage extends radially with respect to the gap between the rotor and the stator. The rotation shaft is configured to be rotated by the motor and drive the compression portion. The flow path guide is positioned at a discharge space between the motor and the compression portion and includes a guide outlet that is in fluid communication with the discharge space and opened in a direction toward the rotation shaft.

In some implementations, the scroll compressor can optionally include one or more of the following features. The flow path guide may include a guide inlet that is radially spaced apart from the guide outlet and in fluid communication with the discharge passage. The guide outlet may be disposed closer to the rotation shaft than the guide inlet is to the rotation shaft. A balance weight may be positioned at the rotation shaft or at the rotor, and located at the discharge space. The guide outlet may be located at a position overlapping an outer circumferential surface of the balance weight. The stator may include a stator core and a stator coil wound around the stator core. An insulating member may be positioned between the stator core and the stator coil. At least a portion of the guide outlet may overlap the insulating member at an inner circumferential side of the stator coil. The flow path guide may include (i) a guide inlet that is radially spaced apart from the guide outlet and in fluid communication with the discharge passage, and (ii) a guide passage that provides fluid communication between the guide inlet and the guide outlet. An inner circumferential surface of the guide passage may define a guide surface inclined or curved toward the guide outlet. A lower surface of the flow path guide may contact with an upper surface of the compression portion that faces the lower surface of the flow path guide to thereby separate an inner side space from a second recovery passage. The inner side space may be defined at an inner circumferential side of the flow path guide in the discharge space. The second recovery passage may be defined at an outer circumferential surface of the compression portion. A third recovery passage may be defined between a lower surface of the flow path guide and a first surface of the compression portion that faces the lower surface of the flow path guide to thereby allow an inner side space to be in fluid communication with a second recovery passage. The inner side space may be defined at an inner circumferential side of the flow path guide in the discharge space. The second recovery passage may be defined at an outer circumferential surface of the compression portion. The third recovery passage may be spaced apart in a circumferential direction from a guide inlet. The guide inlet may define an inlet of the flow path guide. The first surface of the compression portion may define the inner side space at the inner circumferential side of the flow path guide and includes an oil receiving groove. The oil receiving groove may be in fluid communication with the third recovery passage. The third recovery passage may be defined based on the first surface of the compression portion being recessed or on the lower surface of the flow path guide being recessed. The lower surface of the flow path guide may face the first surface of the compression portion. A second surface of the compression portion may face the motor and define a discharge guide groove configured to accommodate the discharge passage. The flow path guide may extend between an outer circumferential surface and an inner circumferential surface of the discharge guide groove in a circumferential direction. The flow path guide may include an outer wall portion defined in an annular shape and extending in a direction toward the motor from the compression portion, and a blocking portion defined in an annular shape and extending in a direction toward the rotation shaft from a first end portion of the outer wall portion. An inner circumferential-side end portion of the blocking portion may be spaced apart from the second surface of the compression portion facing the motor to thereby define the guide outlet. The flow path guide may include a bottom portion extending in a radial direction toward the rotation shaft from a second end portion of the outer wall portion. The bottom portion may include a guide inlet that is in fluid communication with the discharge guide groove. The flow path guide may include an inner wall portion extending in a direction from an inner circumferential side of the bottom portion toward the motor. The inner wall portion may be positioned lower than the outer wall portion and spaced apart from the blocking portion to thereby define the guide outlet. A balance weight may be positioned at the rotation shaft or at the rotor, and located at the discharge space. At least one stirring protrusion or at least one stirring groove may be defined at a circumferential surface of the balance weight. At least one of an inner circumferential surface of the stator or an outer circumferential surface of the rotor may define a stirring groove that extends between opposite ends of the stator or the rotor in the axial direction. The flow path guide may include a lower plate guide coupled to the compression portion and including a guide inlet that is in fluid communication with the discharge passage. The flow path guide may include an upper plate guide coupled to an upper end of the lower plate guide. The guide outlet may be in fluid communication with the gap between the stator and the rotor at a position closer to the rotation shaft than the guide inlet. At least one of the lower plate guide or the upper plate guide may include an outer wall portion extending in the axial direction. An outer circumferential side of the lower plate guide and an outer circumferential side of the upper plate guide may be sealed by the outer wall portion. An inner circumferential side of the lower plate guide and an inner circumferential side of the upper plate guide may be spaced apart from each other to thereby define the guide outlet. The inner circumferential side of the lower plate guide or the inner circumferential side of the upper plate guide may include an inner wall portion. The inner circumferential side of the upper plate guide or the inner circumferential side of the lower plate guide may be spaced apart from the inner wall portion to thereby define the guide outlet. The scroll compressor may include a side plate guide coupled to the compression portion. An inner side of the side plate guide may be opened toward the discharge passage and define a guide inlet. The guide inlet may define an inlet of the flow path guide. The scroll compressor may include an upper plate guide. An outer circumferential side of the upper plate guide may be sealed by an end portion of the side plate guide. An inner circumferential side of the upper plate guide may be spaced apart from a surface of the compression portion to thereby define the guide outlet. The flow path guide may include (i) an outer wall portion coupled to the compression portion and (ii) a blocking portion extending toward the rotation shaft from an end portion of the outer wall portion. An inner side of the outer wall portion may be opened toward the discharge passage and define a guide inlet. An inner circumferential side of the blocking portion may be spaced apart from the compression portion to thereby define the guide outlet. The stator may be defined in a cylindrical shape. An inner circumferential surface of the stator may include a plurality of teeth defined in a circumferential direction with slits interposed therebetween. A stator coil may be wound around the teeth. The guide outlet may be located closer to the rotation shaft than an inner circumferential surface of the stator coil is to the rotation shaft, or located at a same distance to the rotation shaft as the inner circumferential surface of the stator coil is to the rotation shaft.

Particular implementations of the present disclosure provide an air conditioner that includes a scroll compressor, a condenser, an expander, and an evaporator. The scroll compressor may include a casing defining an inner space, a motor, a compression portion, a rotation shaft, and a flow path guide. The motor includes (i) a stator that is fixed in the inner space of the casing and defines a first recovery passage extending between opposite ends of the stator in an axial direction, and (ii) a rotor that is configured to rotate relative to the stator, wherein a gap is defined between the rotor and the stator. The compression portion is fixed to the inner space of the casing and includes a plurality of scrolls. The compression portion defines a discharge passage that is configured to discharge refrigerant compressed by a motion of the plurality of scrolls relative to the inner space of the casing. The discharge passage extends radially with respect to the gap between the rotor and the stator. The rotation shaft is configured to be rotated by the motor and drive the compression portion. The flow path guide is positioned at a discharge space between the motor and the compression portion and includes a guide outlet that is in fluid communication with the discharge space and opened in a direction toward the rotation shaft.

A first aspect of the present disclosure is to provide a scroll compressor and an air conditioner having the same capable of increasing a concentration of oil in a casing.

In addition, the present disclosure provides a scroll compressor and an air conditioner having the same capable of increasing a concentration of oil in a casing by enhancing an oil separation effect for separating oil from liquid refrigerant or gas refrigerant in a discharge space provided between a motor portion and a compression portion.

Further, an aspect of the present disclosure is to provide a scroll compressor and an air conditioner having the same capable of reducing a height of a discharge space while allowing refrigerant discharged to the discharge space to be effectively separated from oil by a balance weight.

A second aspect of the present disclosure is to provide a scroll compressor and an air conditioner having the same configured to effectively separate liquid refrigerant or gas refrigerant from oil in an inner space of a casing.

Further, an aspect of the present disclosure is to provide a scroll compressor and an air conditioner having the same capable of effectively separating refrigerant passed through a motor portion from oil in an upper space of a casing provided above the motor portion.

Furthermore, an aspect of the present disclosure is to provide a scroll compressor and an air conditioner having the same, which allows refrigerant discharged to a discharge space to receive a strong centrifugal force when passing through a motor portion to thereby enhance an oil separation effect in an upper space, and accordingly, reduces a volume of the upper space so as to be advantageous for miniaturization.

A third aspect of the present disclosure is to provide a scroll compressor and an air conditioner having the same capable of increasing convenience and reliability by advancing a normal operation point of the air conditioner to quickly start a cooling/heating operation.

In addition, an aspect of the present disclosure is to provide a scroll compressor and an air conditioner having the same capable of effectively separating oil from liquid refrigerant or gas refrigerant in the compressor at an initial start-up.

Further, an aspect of the present disclosure is to provide a scroll compressor and an air conditioner having the same capable of enhancing an oil separation effect at an initial start-up by stirring refrigerant inside the compressor or providing a centrifugal force.

In order to achieve the first aspect of the present disclosure, a scroll compressor and an air conditioner having the same provided with a flow path guide installed in a discharge space between a motor portion and a compression portion to guide refrigerant discharged to a discharge space toward a central side of the motor portion where a rotation shaft is located may be provided. Accordingly, refrigerant discharged to the discharge space moves toward the central side of the motor portion to enhance an oil separation effect in the discharge space. This may increase a possibility of vaporization of gas refrigerant or liquid refrigerant separated from oil, while the oil separated from the gas refrigerant remains in the casing rather than flowing out, and thus a concentration of oil in the casing may be increased.

For example, an outlet of a flow path guide may be disposed closer to an outer circumferential surface of a balance weight installed in the discharge space than an inlet of the flow path guide. Accordingly, refrigerant discharged to the discharge space through the outlet of the flow path guide is stirred by the balance weight, thereby improving the oil separation effect in the discharge space.

As another example, the outlet of the flow path guide may overlap the balance weight installed in the discharge space in an axial direction. Accordingly, refrigerant discharged toward a rotation shaft through the outlet of the flow path guide is concentrated around the balance weight, thereby improving the oil separation effect in the discharge space. At the same time, a height of the discharge space may be lowered by arranging the balance weight and the flow path guide in a radial direction.

In order to achieve the second aspect of the present disclosure, a scroll compressor and an air conditioner having the same provided with a flow path guide provided between the motor portion and the compression portion and extending in a direction crossing an inner passage passing through an inner portion of the motor portion in the axial direction to block an outer portion of the inner passage may be provided. Accordingly, the refrigerant discharged to the discharge space through the outlet of the flow path guide does not flow directly into the inner passage of the motor portion but moves toward an air gap, thereby improving the oil separation effect.

For example, the outlet of the flow path guide may be opened in the radial direction. Accordingly, the refrigerant discharged to the discharge space is discharged toward a central side of the discharge space, and thus most of the refrigerant may pass through the motor portion through the air gap disposed at the central side rather than passing through the inner passage disposed at an outer side of the motor portion. Therefore, the refrigerant passed through the motor portion to be discharged to the upper space is to receive a strong rotational force from the rotor while passing through the air gap, thereby improving the oil separation effect in an oil separation space.

As another example, the outlet of the flow path guide may be located more inward than an outer circumferential surface of a stator coil. Accordingly, the outlet of the flow path guide may be disposed close to an air gap formed between an inner circumferential surface of a stator and an outer circumferential surface of a rotor to thereby increase a possibility of the refrigerant discharged to the discharge space being guided toward the air gap. At the same time, a volume of the upper space may be minimized by enhancing the oil separation effect in the upper space, thereby realizing miniaturization of the compressor.

In order to achieve the third aspect of the present disclosure, there may be provided a scroll compressor capable of effectively separating oil from liquid refrigerant or gas refrigerant inside the compressor while performing a normal operation. Accordingly, at an initial start-up of the compressor, the liquid refrigerant or oil is prevented from leaking out of the inner space of the compressor, so that the air conditioner can quickly start a cooling operation or a heating operation.

For example, refrigerant discharged from the compression portion may receive a sufficient centrifugal force in the inner space of the compressor to allow oil to be centrifuged from liquid refrigerant or gas refrigerant. Accordingly, oil may be effectively separated from liquid refrigerant or gas refrigerant inside the compressor during an initial start-up.

As another example, the refrigerant discharged from the compression portion may be guided adjacent to the balance weight or the rotor to receive a centrifugal force by a rotational force of the balance weight or a rotational force of the rotor. Accordingly, the oil separation effect during the initial start-up may be enhanced by providing a centrifugal force to the refrigerant without using separate power or components.

In addition, in order to achieve an aspect of the present disclosure, a casing is provided with a sealed inner space. A motor portion provided in the inner space of the casing includes a stator fixed in the inner space of the casing and provided with a first recovery passage passing between both ends of the stator in an axial direction, and a rotor rotatably provided in the stator with a predetermined air gap therebetween. A compression portion fixed to the inner space of the casing at one side of the motor portion in the axial direction forms a compression chamber configured to compress refrigerant by a relative motion of a plurality of scrolls, and provided with a discharge passage configured to discharge the compressed refrigerant at a position radially outward with respect to the air gap of the motor portion. The motor portion and the compression portion are coupled by a rotation shaft that transmits a driving force from the motor portion to the compression portion. A flow path guide provided in a discharge space between the motor portion and the compression portion may be provided with a guide outlet communicating with the discharge space and opened in a direction toward the rotation shaft.

Accordingly, the refrigerant discharged to the discharge space through the flow path guide does not flow directly into the inner passage passing through the inner portion of the motor portion in the axial direction, but moves in the direction toward the rotation shaft.

This may allow the refrigerant discharged to the discharge space to be separated from oil while being stirred by a rotating body in the discharge space to enhance the oil separation effect of the refrigerant. As a result, a leakage of liquid refrigerant or oil together with gas refrigerant to the outside of the compressor is minimized, thereby suppressing friction loss or damage caused by abrasion inside the compressor.

In particular, even in a case where the liquid refrigerant is excessively introduced from the refrigeration cycle at the initial start-up of the compressor, there is no need to perform a delayed operation because oil is effectively separated from the liquid refrigerant or gas refrigerant to thereby increase a vaporization of the liquid refrigerant and increase a concentration of the oil. This may enable a quick start of a normal operation.

For example, the flow path guide may further include a guide inlet spaced apart from the guide outlet in the radial direction and communicating with the discharge passage. The guide outlet may be disposed closer to the rotation shaft than the guide inlet. Accordingly, a position of the guide outlet may be moved remarkably closer to the central side than the guide inlet to guide the refrigerant discharged to the discharge space through the guide outlet toward the rotation shaft.

As another example, the discharge space may be provided with a balance weight installed at the rotation shaft or at the rotor, and the guide outlet may be formed at a position overlapping an outer circumferential surface of the balance weight in the axial direction. Accordingly, the refrigerant discharged from the guide outlet may be guided toward the balance weight, thereby improving the oil separation effect by the stirring of the balance weight.

As another example, the stator may be provided with a stator core and a stator coil wound around the stator core, and an insulating member may be provided between the stator core and the stator coil. At least a portion of the guide outlet may overlap the insulating member in a radial direction at an inner circumferential side of the stator coil. This may prevent the discharged refrigerant from moving toward a slit where the stator coil is wound, so that the refrigerant can move to the upper space through the air gap.

As another example, the flow path guide may further include a guide inlet spaced apart from the guide outlet in a radial direction and communicating with the discharge passage, and a guide passage communicating between the guide inlet and the guide outlet. An inner circumferential surface of the guide passage may form a guide surface inclined or curved toward the guide outlet. This may suppress an occurrence of eddy current inside the flow path guide to reduce a flow resistance of the refrigerant inside the flow path guide.

As another example, a lower surface of the flow path guide and an upper surface of the compression portion facing the lower surface of the flow path guide may be in close contact with each other, so that an inner side space formed at an inner circumferential side of the flow path guide in the discharge space may be separated from a second recovery passage provided at an outer circumferential surface of the compression portion. Accordingly, the refrigerant discharged from the guide outlet of the flow path guide to the discharge passage may not flow back into the storage space, or the likes, but may be concentrated to be discharged to the air gap of the motor portion.

As another example, a third recovery passage may be provided between a lower surface of the flow path guide and one surface of the compression portion facing the lower surface of the flow path guide so that an inner side space formed at an inner circumferential side of the flow path guide in the discharge space may communicate with a second recovery passage provided at an outer circumferential surface of the compression portion. The third recovery passage may be spaced apart in a circumferential direction from a guide inlet forming an inlet of the flow path guide. Accordingly, oil remained after lubricating the bearing surface may be quickly recovered to the storage space to thereby prevent the oil from being mixed again in the refrigerant discharged through the guide outlet of the flow path guide.

As another example, one surface of the compression portion forming an inner side space at the inner circumferential side of the flow path guide may be provided with an oil receiving groove recessed by a predetermined depth, and the oil receiving groove may communicate with one end of the third recovery passage. Accordingly, the separated oil may be collected in the oil receiving groove to be quickly moved to the second recovery passage.

As another example, the third recovery passage may be formed such that one surface of the compression portion or one surface of the flow path guide facing the one surface of the compression portion is recessed. Accordingly, a third passage can be easily formed.

As another example, one surface of the compression portion facing the motor portion may be provided with a discharge guide groove to accommodate the discharge passage. The flow path guide may be coupled to cross between an outer circumferential surface and an inner circumferential surface of the discharge guide groove in a circumferential direction. Accordingly, an area of a passage through which oil is recovered may be secured at the outer circumferential surface of the compression portion.

As another example, the flow path guide may include an outer wall portion defined in an annular shape and extending in a direction toward the motor portion from the compression portion, and a blocking portion defined in an annular shape and extending in a direction toward the rotation shaft from a motor portion-side end portion of the outer wall portion. An inner circumferential-side end portion of the blocking portion may be spaced apart from one surface of the compression portion facing the motor portion to form the guide outlet. Accordingly, the flow path guide is integrally formed, and therefore, the flow path guide can be easily manufactured.

As another example, the outer wall portion may be disposed between the outer circumferential surface and the inner circumferential surface of the discharge guide groove, and an outer circumferential surface of the outer wall portion may be provided with a discharge passage covering portion extending therefrom to cover the discharge guide groove disposed at an outer side of the flow path guide. Accordingly, the discharge passage may be formed as close as possible to an outer portion of the compression portion to secure a volume of the compression chamber while suppressing an interference with the oil recovery passage provided at the outer circumferential surface of the compression portion.

As another example, the flow path guide may further include a bottom portion extending in a radial direction toward the rotation shaft from a compression portion-side end portion of the outer wall portion. The bottom portion may be provided with a guide inlet opened to communicate with the discharge guide groove. This may allow the flow path guide to be stably fixed and form a ledge equal to a thickness of the bottom portion to thereby block the oil separated from the discharge space from flowing into the discharge guide groove.

As another example, the flow path guide may further include an inner wall portion extending in a direction from an inner circumferential side of the bottom portion toward the motor portion. The inner wall portion may be formed lower than the outer wall portion and spaced apart from the blocking portion to form the guide outlet. Accordingly, the discharge space and the inner space formed at the inner circumferential side of the flow path guide may be partially blocked, so that the oil separated from the discharge space can be more effectively blocked from flowing into the discharge guide groove.

As another example, the discharge space may be further provided with a balance weight installed at the rotation shaft or at the rotor. At least one stirring protrusion or stirring groove may be provided on a circumferential surface of the balance weight. Accordingly, the oil separation effect can be enhanced using the balance weight.

As another example, the stirring protrusion or the stirring groove may extend in the axial direction, an oblique direction, or a helical direction, and overlap the guide outlet in the axial direction. Accordingly, the oil separation effect can be enhanced using the balance weight.

As another example, at least one of an inner circumferential surface of the stator and an outer circumferential surface of the rotor may be provided with a stirring groove passing between both ends thereof in the axial direction. Accordingly, a centrifugal force is provided to the refrigerant passing through the air gap of the motor portion to thereby enhance the oil separation effect.

As another example, the stirring groove may be formed in the axial direction, an oblique direction, or a helical direction. This may further enhance the oil separation effect using the motor portion.

As another example, the flow path guide may include a lower plate guide coupled to the compression portion and provided with a guide inlet to communicate with the discharge passage, and an upper plate guide coupled to an upper end of the lower plate guide and provided with the guide outlet at a position closer to the rotation shaft than the guide inlet. Accordingly, a flow path guide with an open inner circumference so as to block the motor portion side in the discharge space can be easily manufactured.

As another example, the lower plate guide or the upper plate guide may be provided with at least one support rib extending toward a plate guide on an opposite side thereof to maintain a gap between the lower plate guide and the upper plate guide. Accordingly, the lower plate guide and the upper plate guide of the flow path guide coupled to each other in a manner that only an outer wall side thereof is sealed may be easily assembled, and the assembled shape thereof may be stably maintained.

As another example, at least one of the lower plate guide and the upper plate guide may be provided with an outer wall portion extending in the axial direction, and an outer circumferential side of the lower plate guide and an outer circumferential side of the upper plate guide may be sealed by the outer wall portion, and an inner circumferential side of the lower plate guide and an inner circumferential side of the upper plate guide may be spaced apart from each other to form the guide outlet. Accordingly, a separate guide inlet is not provided at the lower plate guide except for the bottom portion, and this simplifies a structure of the lower plate guide to thereby lower a manufacturing cost for the flow path guide.

As another example, the inner circumferential side of the lower plate guide or the inner circumferential side of the upper plate guide may be further provided with an inner wall portion extending toward a plate guide on an opposite side thereof, and the inner circumferential side of the upper plate guide or the inner circumferential side of the lower plate guide may be spaced apart from the inner wall portion to form the guide outlet. Accordingly, the discharge space and the inner space of the flow path guide may be partially blocked while securing the guide outlet at the inner circumferential side of the flow path guide to thereby more effectively block the oil separated from the discharge space from flowing into the discharge guide groove.

As another example, the scroll compressor may include a side plate guide coupled to the compression portion, wherein an inner side of the side plate guide is opened toward the discharge passage to form a guide inlet forming an inlet of the flow path guide, and an upper plate guide, wherein an outer circumferential side of the upper plate guide is sealed by a motor portion-side end portion of the side plate guide and an inner circumferential side of the upper plate guide is spaced apart from one surface of the compression portion to form the guide outlet. Accordingly, a structure of the lower plate guide may be simplified while securing the guide outlet at the inner circumferential side, thereby reducing the manufacturing cost for the flow path guide.

As another example, the flow path guide may include an outer wall portion coupled to the compression portion and a blocking portion integrally extending toward the rotation shaft from a motor portion-side end portion of the outer wall portion, wherein an inner side of the outer wall portion may be opened toward the discharge passage to form a guide inlet, and an inner circumferential side of the blocking portion may be spaced apart from the compression portion to form the guide outlet. Accordingly, the flow path guide may be formed as a single body while forming the guide inlet and the guide outlet to thereby reduce the manufacturing cost for the flow path guide.

As another example, the stator may be defined in a cylindrical shape, an inner circumferential surface of the stator may be provided with a plurality of teeth formed in a circumferential direction with slits interposed therebetween, and a stator coil may be wound around the teeth. The guide outlet may be located closer to the rotation shaft than an inner circumferential surface of the stator coil. And, as the guide outlet is formed more inward than the outer circumferential surface of the stator coil of the motor portion, a movement of refrigerant in which refrigerant flowing into the discharge space through the flow path guide is moved to the upper space through the slit where the stator coil is wound may be reduced.

As another example, the guide outlet may be located closer to the rotation shaft than an inner circumferential surface of the stator coil, or located on a same axis line as the inner circumferential surface of the stator coil. And, as the guide outlet is formed more inward than the stator coil of the motor portion, refrigerant flowing into the discharge space through the flow path guide to move to the upper space through the slit where the stator coil is wound may be minimized. Accordingly, the refrigerant is firstly separated from oil in the discharge space, then is moved to the upper space by receiving a centrifugal force while passing through the air gap so as to be secondly separated from oil, thereby improving the overall oil separation effect.

In order to achieve an aspect of the present disclosure, in an air conditioner including a compressor, a condenser, an expander, and an evaporator, a scroll compressor defined above may be applied to the compressor. Accordingly, as liquid refrigerant and oil can be smoothly separated from gas refrigerant in the compressor to thereby improve a vaporization of the liquid refrigerant and block an outflow of oil, friction loss and abrasion between members due to oil shortage can be suppressed, and thereby enabling rapid cooling and heating.

DETAILED DESCRIPTION

Hereinafter, a scroll compressor and an air conditioner having the same according to the present disclosure will be described in detail with reference to the accompanying drawings. In the followings, descriptions of several components will be omitted in order to clarify technical features of the present disclosure.

The term "energization" used in the following description means that one component is electrically connected to another component or is connected to enable information communication. Energization may be implemented by conducting wires, communication cables, or the like.

In addition, "upward" used in the following description refers to a direction away from a support surface supporting the scroll compressor according to an embodiment of the present disclosure, that is, a direction toward a motor portion. "Downward" refers to a direction closer to the support surface, that is, a direction toward the compression portion.

In addition, the term "axial direction" used in the following description refers to a longitudinal direction of a rotation shaft. The "axial direction" may be understood as a vertical direction. A "radial direction" refers to a direction intersecting the rotation shaft.

Further, in the following, a lower compression-type scroll compressor in which the motor portion and the compression portion are arranged up and down in the axial direction and the compression portion is located below the motor portion will be described as an example.

In addition, a high-pressure and lower compression-type scroll compressor in which a refrigerant suction pipe forming a suction passage is directly connected to the compression portion and a refrigerant discharge pipe is communicated with an inner space of a casing will be described as an example.

Figure 1:
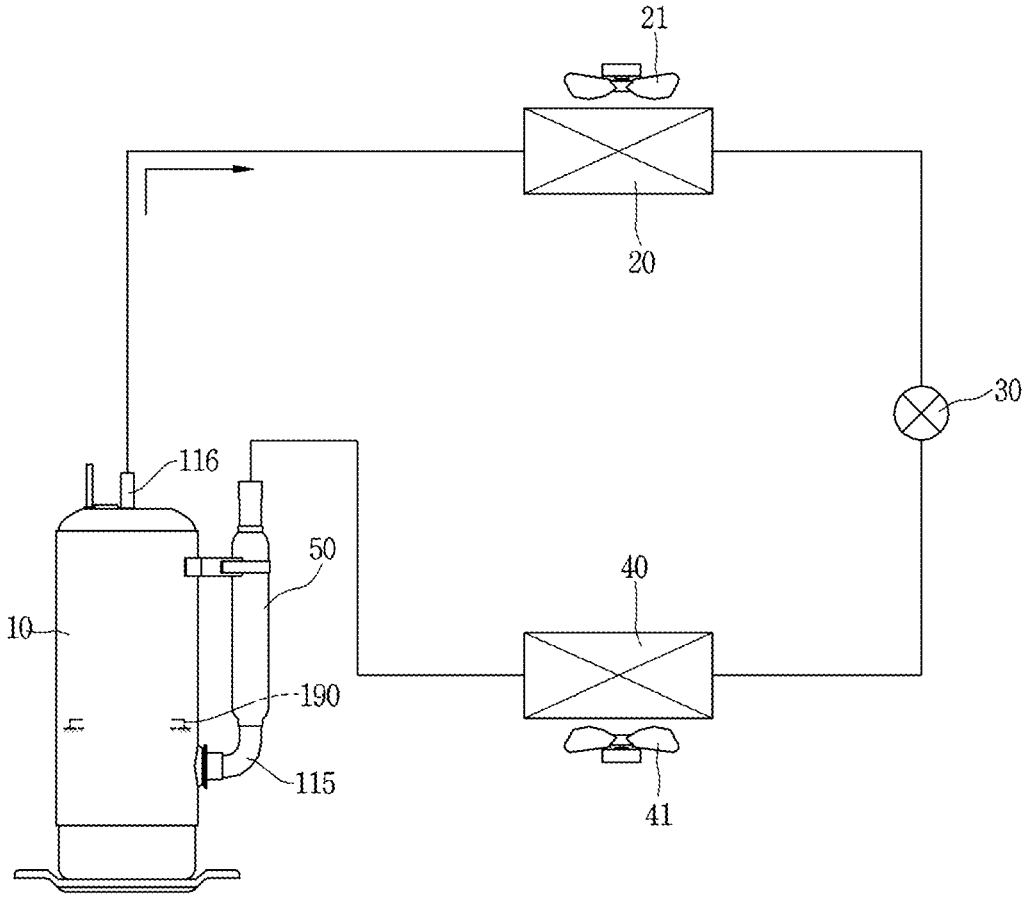
FIG. 1 is a block diagram illustrating a refrigeration cycle device to which a lower compression-type scroll compressor is applied according to this embodiment.

FIG. 1 is a block diagram illustrating a refrigeration cycle device to which a lower compression-type scroll compressor is applied according to this embodiment.

Referring to FIG. 1, the refrigeration cycle device to which the scroll compressor according to this embodiment is applied is configured such that a compressor 10, a condenser 20, an expander 30, and an evaporator 40 form a closed loop. That is, the condenser 20, the expander 30, and the evaporator 40 are sequentially connected to a discharge side of the compressor 10, and a discharge side of the evaporator 40 is connected to a suction side of the compressor 10.

Accordingly, a series of processes in which refrigerant is compressed by the compressor 10, discharged toward the condenser 20, passes through the expander 30 and the evaporator 40, and then sucked back into the compressor 10 is repeatedly performed.

Figure 2:
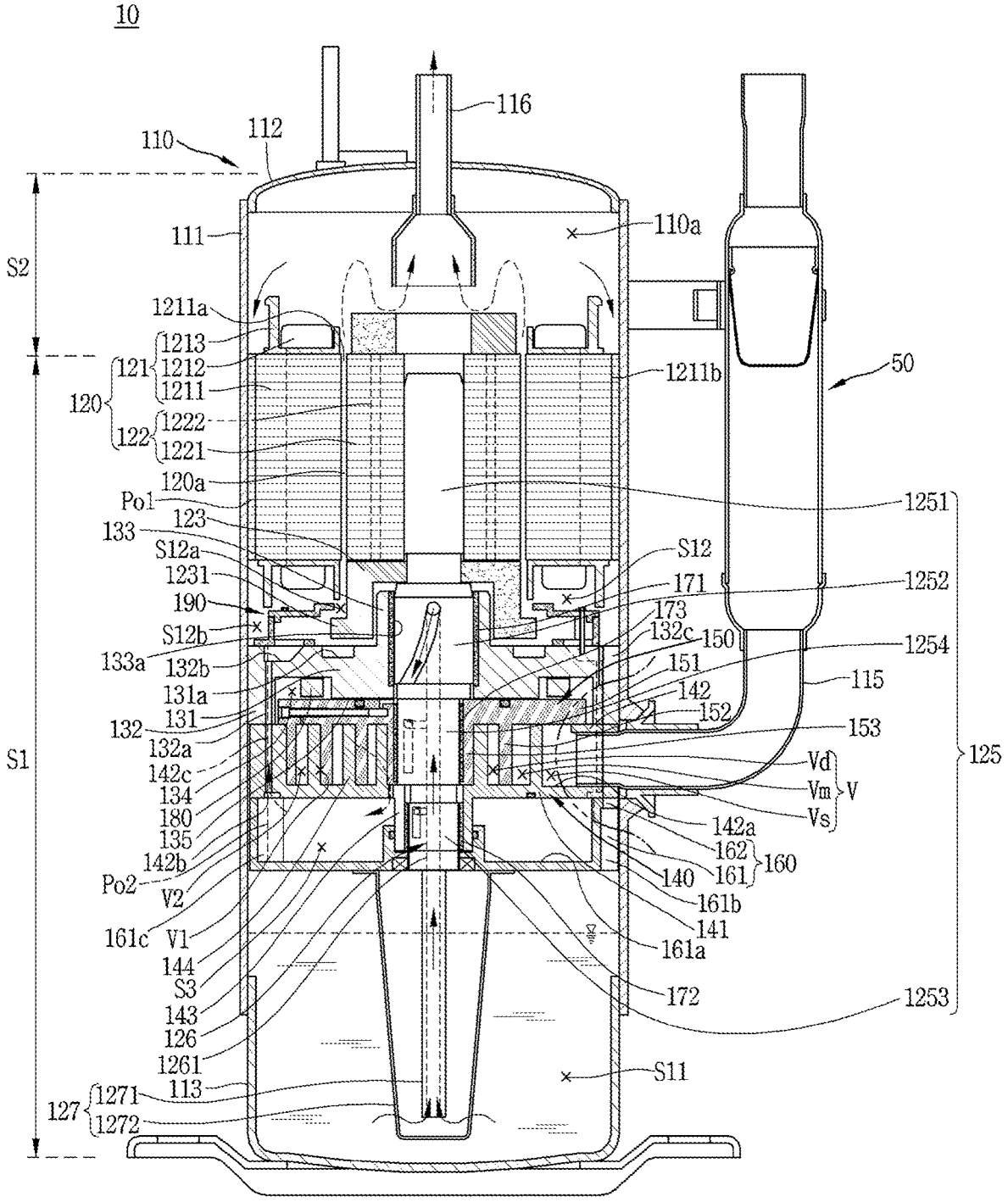
FIG. 2 is a longitudinal sectional view of a lower compression-type scroll compressor according to this embodiment.

FIG. 2 is a longitudinal sectional view of the lower compression-type scroll compressor according to this embodiment.

Referring to FIG. 2, a high-pressure and lower compression-type scroll compressor (hereinafter, referred to as a scroll compressor) according to this embodiment is provided with a driving motor 120 installed in an upper portion of a casing 110, and under the driving motor 120, a main frame 130, a fixed scroll 140, an orbiting scroll 150, and a discharge cover 160 are sequentially installed. In general, the driving motor 120 constitutes the motor portion, and the main frame 130, the fixed scroll 140, the orbiting scroll 150, and the discharge cover 160 constitute the compression portion.

The motor portion is coupled to an upper end of a rotation shaft 125 to be described later, and the compression portion is coupled to a lower end of the rotation shaft 125. Accordingly, the compressor has the above-described lower compression-type structure, and the compression portion is connected to the motor portion by the rotation shaft 125 and is operated by a rotational force of the motor portion.

Referring to FIG. 2, the casing 110 according to this embodiment may include a cylindrical shell 111, an upper shell 112, and a lower shell 113. The cylindrical shell 111 is defined in a cylindrical shape with an upper end and a lower end thereof being opened, the upper shell 112 is coupled to cover the opened upper end of the cylindrical shell 111, and the lower shell 113 is coupled to cover the opened lower end of the cylindrical shell 111. Accordingly, an inner space 110*a* of the casing 110 is sealed, and the sealed inner space 110*a* of the casing 110 is divided into a lower space S1 and an upper space S2 with the driving motor 120 therebetween.

The lower space S1 is a space formed under the driving motor 120, and the lower space S1 may be further divided into a storage space S11 and a discharge space S12 with the compression portion therebetween.

The storage space S11 is a space formed under the compression portion to store oil or mixed oil in which liquid refrigerant is mixed. The discharge space S12 is a space formed between an upper surface of the compression portion and a lower surface of the driving motor 120 where refrigerant compressed in the compression portion or mixed refrigerant in which oil is mixed is discharged.

The upper space S2 is formed above the driving motor 120 to form an oil separating space in which oil is separated from refrigerant that is discharged from the compression portion. The upper space S2 communicates with the refrigerant discharge pipe.

The cylindrical shell 111 is provided with the above-described driving motor 120 and the main frame 130 inserted thereinto. An outer circumferential surface of the driving motor 120 and an outer circumferential surface of the main frame 130 may be respectively provided with an oil recovery passages Po1 and oil recovery passage Po2 each spaced apart from an inner circumferential surface of the cylindrical shell 111 by a predetermined distance. This will be described again later with the oil recovery passage.

A side surface of the cylindrical shell 111 is provided with a refrigerant suction pipe 115 formed therethrough. Accordingly, the refrigerant suction pipe 115 forms through the cylindrical shell 111 constituting the casing 110 in the radial direction.

The refrigerant suction pipe 115 is defined in an L-shape, and one end thereof passes through the cylindrical shell 111 to directly communicate with a suction port 142*a* of the fixed scroll 140 that constitutes the compression portion. Accordingly, refrigerant may be introduced into a compression chamber V through the refrigerant suction pipe 115.

Another end of the refrigerant suction pipe 115 is connected to an accumulator 50 forming a suction passage outside the cylindrical shell 111. The accumulator 50 is connected to an outlet side of the evaporator 40 by a refrigerant pipe. Accordingly, refrigerant moving from the evaporator 40 to the accumulator 50 is directly sucked into the compression chamber V through the refrigerant suction pipe 115 after liquid refrigerant is separated in the accumulator 50.

A terminal bracket (not illustrated) may be coupled to an upper portion of the cylindrical shell 111 or to the upper shell 112, and a terminal (not illustrated) for transmitting external power to the driving motor 120 may be coupled through the terminal bracket.

An upper portion of the upper shell 112 is provided with a refrigerant discharge pipe 116 coupled therethrough to allow the refrigerant discharge pipe 116 to communicate with the inner space 110*a* of the casing 110, specifically, the upper space S2 formed above the driving motor 120. The refrigerant discharge pipe 116 corresponds to a passage through which compressed refrigerant discharged from the compression portion to the inner space 110*a* of the casing 110 is discharged outside toward the condenser 20.

In the refrigerant discharge pipe 116, there may be installed an oil separation device (not illustrated) to separate oil from refrigerant that is discharged from the compressor 10 to the condenser 20, or a check valve (not illustrated) to block refrigerant discharged from the compressor 10 from flowing back into the compressor 10.

At a lower portion of the lower shell 113, one end portion of an oil circulation pipe (not illustrated) may be coupled therethrough. Both ends of the oil circulation pipe are open, and another end of the oil circulation pipe may be coupled through the refrigerant suction pipe 115. An oil circulation valve (not illustrated) may be installed at a middle portion of the oil circulation pipe.

The oil circulation valve may be opened or closed according to an amount of oil stored in the storage space S11 or according to a set condition. For example, the oil circulation valve may prevent oil from excessively outflowing from the compressor by being opened to allow the oil stored in the storage space to circulate to the compression portion through the refrigerant suction pipe at the beginning of operation of the compressor, whereas being closed when the compressor is in a normal operation.

Next, the driving motor that constitutes the motor portion will be described.

Referring to FIG. 2, the driving motor 120 according to this embodiment includes a stator 121 and a rotor 122. The stator 121 is inserted into the inner circumferential surface of the cylindrical shell 111, and the rotor 122 is rotatably provided inside the stator 121.

The stator 121 includes a stator core 1211 and stator coils 1212.

The stator core 1211 is defined in an annular or hollow cylindrical shape, and is fixed to the inner circumferential surface of the cylindrical shell 111 by hot pressing.

A middle portion of the stator core 1211 is provided with a rotor accommodating portion 1211*a* passing circularly therethrough, and an outer circumferential surface of the stator core 1211 is provided with a plurality of stator-side oil recovery grooves 1211*b* recessed in a D-cut shape in the axial direction. The plurality of stator-side oil recovery grooves 1211*b* may be disposed at predetermined intervals in a circumferential direction.

A circumferential surface of the rotor accommodating portion 1211*a* may be formed flat in a smooth tube shape, but in some cases, may be provided with a stirring groove 121*a*. The stirring groove 121*a* may be formed helically or obliquely in a forward direction with respect to a rotation direction of the rotation shaft 125. Accordingly, refrigerant (or mixed refrigerant) passing through a flow path guide 190, to be described later, may be smoothly introduced into an air gap 120*a*, and may receive a greater centrifugal force to thereby be discharged to the upper space S2. This will be described again later in other embodiments.

As the outer circumferential surface of the stator core 1211 is coupled with the inner circumferential surface of the cylindrical shell 111, a predetermined space with open upper and lower sides is formed between the stator-side oil recovery grooves 1211*b* and the inner circumferential surface of the cylindrical shell 111. This space forms a first recovery passage through which oil in the upper space S2 is moved to the lower space S1. The first recovery passage forms a first oil recovery passage Po1.

Accordingly, oil separated from refrigerant in the upper space S2 moves to the discharge space S12 forming a part of the lower space S1 through the first oil recovery passage Po1, and then recovered into the storage space S11 forming a part of the lower space S1 through a second oil recovery passage Po2 to be described later. The second oil recovery passage Po2 is recessed from an outer circumferential surface of the compression portion to form a predetermined space with open upper and lower sides together with the inner circumferential surface of the cylindrical shell 111. This space forms a second recovery passage, and the second recovery passage forms the second oil recovery passage Po2. The second oil recovery passage will be described later together with the first oil recovery passage.

The stator coils 1212 are wound around the stator core 1211 and are electrically connected to an external power source through a terminal (not illustrated) that is coupled through the casing 110. An insulator 1213, which is an insulating member, is inserted between the stator core 1211 and the stator coils 1212.

The insulator 1213 may be provided at an outer circumferential side and an inner circumferential side to accommodate a bundle of stator coils 1212 in the radial direction to extend in an axial direction of the stator core 1211.

The rotor 122 includes a rotor core 1221 and a permanent magnet 1222.

The rotor core 1221 is defined in a cylindrical shape and is accommodated in a space formed at a central portion of the stator core 1211.

Specifically, the rotor core 1221 is rotatably inserted into the rotor accommodating portion 1211*a* of the stator core 1211 with a predetermined gap 120*a* therebetween. The permanent magnet 1222 is embedded in the rotor core 1221 with a predetermined gap in the circumferential direction.

An outer circumferential surface of the rotor core 1221 may be defined in a shape of a smooth tube having a constant outer diameter. However, in some cases, a stirring groove 122*a* may be formed on the outer circumferential surface of the rotor core 1221 so that refrigerant (or mixed refrigerant) passing through the flow path guide 190, to be described later, flows smoothly into the air gap. The stirring groove 122*a* may be formed helically or obliquely in a forward direction with respect to a rotation direction of the rotation shaft 125. This will be described again later with other embodiments.

A lower end of the rotor core 1221 may be provided with a balance weight 123 coupled thereto. However, the balance weight 123 may also be coupled to a main shaft portion 1251 of the rotation shaft 125 to be described later. This embodiment will be described with reference to an example in which the balance weight 123 is coupled to the rotation shaft 125. Balance weights 123 each is installed at a lower end side and an upper end side of the rotor, respectively, and installed symmetrically to each other. The balance weight 123 will be described later together with the flow path guide 190.

A center of the rotor core 1221 is provided with the rotation shaft 125 coupled thereto. An upper end portion of the rotation shaft 125 is press-fitted into the rotor 122, and a lower end portion of the rotation shaft 125 is rotatably inserted into the main frame 130 to be supported in the radial direction.

The main frame 130 is provided with a main bearing 171 configured as a bush bearing to support the lower end portion of the rotation shaft 125. Accordingly, a part of the lower end portion of the rotation shaft 125 inserted in the main frame 130 may be smoothly rotated inside the main frame 130.

The rotation shaft 125 transmits a rotational force of the driving motor 120 to the orbiting scroll 150 constituting the compression portion. Accordingly, the orbiting scroll 150 eccentrically coupled to the rotation shaft 125 rotates with respect to the fixed scroll 140.

Referring to FIG. 2, the rotation shaft 125 according to this embodiment includes the main shaft portion 1251, a first bearing portion 1252, a second bearing portion 1253, and an eccentric portion 1254.

The main shaft portion 1251 is an upper portion of the rotation shaft 125 and is defined in a cylindrical shape. The main shaft portion 1251 may be partially press-fitted to the rotor core 1221.

The first bearing portion 1252 is a portion extending from a lower end of the main shaft portion 1251. The first bearing portion 1252 may be inserted in a main bearing hole 133*a* of the main frame 130 to be supported in the radial direction.

The second bearing portion 1253 refers to a lower portion of the rotation shaft 125. The second bearing portion 1253 may be inserted into a sub bearing hole 143*a* of the fixed scroll 140 to be supported in the radial direction. A central axis of the second bearing portion 1253 and a central axis of the first bearing portion 1252 may be arranged on a same line. In other words, the first bearing portion 1252 and the second bearing portion 1253 have a same central axis.

The eccentric portion 1254 is provided between a lower end of the first bearing portion 1252 and an upper end of the second bearing portion 1253. The eccentric portion 1254 may be inserted into a rotation shaft coupling portion 153 of the orbiting scroll 150 to be described later.

The eccentric portion 1254 may be eccentrically provided in the radial direction with respect to the first bearing portion 1252 and the second bearing portion 1253. In other words, the central axis of the first bearing portion 1252 and the second bearing portion 1253 may be inconsistent with a central axis of the eccentric portion 1254. Accordingly, when the rotation shaft 125 rotates, the orbiting scroll 150 may rotate with respect to the fixed scroll 140.

Meanwhile, an oil supply passage 126 to supply oil to the first bearing portion 1252, the second bearing portion 1253, and the eccentric portion 1254 is provided inside the rotation shaft 125. The oil supply passage 126 includes an inner oil passage 1261 formed in the axial direction inside the rotation shaft 125.

As the compression portion is located under the motor portion, the inner oil passage 1261 may be formed from the lower end of the rotation shaft 125 to approximately a lower end or a middle portion of the stator 121 or a position higher than an upper end of the first bearing portion 1252 in a grooving manner. However, in an embodiment not illustrated, the inner oil passage 1261 may pass through the rotation shaft 125 in the axial direction.

The lower end of the rotation shaft 125, namely, a lower end of the second bearing portion 1253 may be provided with an oil pickup 127 to pump up oil filled in the storage space S11 coupled thereto. The oil pickup 127 may include an oil supply pipe 1271 inserted into the inner oil passage 1261 of the rotation shaft 125, and a blocking member 1272 to block an introduction of foreign substances by receiving the oil supply pipe 1271 therein. The oil supply pipe 1271 may pass through the discharge cover 160 to extend downwards so as to be immersed in oil in the storage space S11.

The rotation shaft 125 may be provided with a plurality of oil supply holes in communication with the inner oil passage 1261 to guide oil moving upwards through the inner oil passage 1261 to the first bearing portion 1252, the second bearing portion 1253, and the eccentric portion 1254.

Next, the compression portion will be described.

Referring to FIG. 2, the compression portion according to this embodiment includes the main frame 130, the fixed scroll 140, the orbiting scroll 150, and the discharge cover 160.

The main frame 130 includes a frame disk portion 131, a frame side wall portion 132, a main bearing portion 133, a scroll accommodating portion 134, and a scroll supporting portion 135.

The frame disk portion 131 is defined in an annular shape and is installed under the driving motor 120. The frame side wall portion 132 extends in a cylindrical shape from an edge of a lower surface of the frame disk portion 131, and an outer circumferential surface of the frame side wall portion 132 is fixed to the inner circumferential surface of the cylindrical shell 111 by hot pressing or welding. Accordingly, the storage space S11 and the discharge space S12 constituting the lower space S1 of the casing 110 are separated by the frame disk portion 131 and the frame side wall portion 132.

The scroll accommodating portion 134 to be described later is provided inside the frame side wall portion 132. The orbiting scroll 150 to be described later is rotatably accommodated in the scroll accommodating portion 134. An inner diameter of the frame side wall portion 132 is larger than an outer diameter of an orbiting disk portion 151 to be described later.

A frame-side discharge hole (hereinafter, second discharge hole) 132*a* forming a part of the discharge passage may be formed through the frame side wall portion 132 in the axial direction. The second discharge hole 132*a* is formed to correspond to a scroll-side discharge hole (or a first discharge hole) 142*b* of the fixed scroll 140, to be described later, to form refrigerant discharge passage (not illustrated) together with the first discharge hole 142*b*.

The second discharge hole 132*a* may be elongated in the circumferential direction, or a plurality of second discharge holes 132*a* may be formed at predetermined intervals in the circumferential direction. Accordingly, a volume of the compression chamber may be secured relative to a same diameter of the main frame 130 by keeping a radial width of the second discharge hole 132*a* to a minimum while securing a discharge area of the second discharge hole 132*a*. The same may be applied to the first discharge hole 142*b* provided in the fixed scroll 140 to form a part of the discharge passage.

A discharge guide groove 132*b* to accommodate the plurality of second discharge holes 132*a* may be formed at an upper end of the second discharge hole 132*a*, namely, an upper surface of the frame disk portion 131. At least one discharge guide groove 132*b* may be formed according to positions of the second discharge holes 132*a*. For example, when the second discharge holes 132*a* form three groups, the discharge guide groove 132*b* may be provided in three so that each of the discharge guide grooves 132*b* accommodates each of the three groups of the second discharge hole 132*a*. The three discharge guide grooves 132*b* may be located on a same line in the circumferential direction.

The discharge guide groove 132*b* may be formed wider than the second discharge hole 132*a*. For example, the second discharge hole 132*a* and a first oil recovery groove 132*c*, to be described later, may be formed on a same line in the circumferential direction. Therefore, when the flow path guide 190 to be described later is provided, it is difficult to place the second discharge hole 132*a* having a small cross-sectional area at an inner side of the flow path guide 190. With this reason, the discharge guide groove 132*b* may be formed at an end portion of the second discharge hole 132*a* with an inner circumferential side of the discharge guide groove 132*b* extending radially inward of the flow path guide 190.

Accordingly, by forming an inner diameter of the second discharge hole 132*a* small, the second discharge hole 132*a* may be located adjacent to an outer circumferential surface of the frame 130 without being pushed to an outer side of the flow path guide 190, namely, an outer circumferential surface side of the stator 121. The discharge guide groove will be described later together with the flow path guide.

An outer circumferential surface of the frame disk portion 131 and the outer circumferential surface of the frame side wall portion 132 constituting the outer circumferential surface of the main frame 130, may be provided with a frame-side oil recovery groove (hereinafter, first oil recovery groove) 132*c* formed therethrough in the axial direction to form a part of the second oil recovery passage Po2, which is a second recovery passage. The first oil recovery groove 132*c* may be provided in one, or may be formed along the outer circumferential surface of the main frame 130 at predetermined intervals in the circumferential direction. Accordingly, the discharge space S12 of the casing may communicate with the storage space S11 of the casing 110 through the first oil recovery groove 132*c*.

The first oil recovery groove 132*c* is formed to correspond/to a scroll oil recovery groove (or second oil recovery groove) 142*c* of the fixed scroll 140, to be described later, to form the second recovery passage, which is the second oil recovery passage, together with the scroll oil recovery groove 142*c* of the fixed scroll 140.

The main bearing portion 133 protrudes upwardly toward the driving motor 120 from an upper surface of a central portion of the frame disk portion 131. The main bearing portion 133 is provided with the main bearing hole 133*a* defined in a cylindrical shape and formed therethrough in the axial direction, and an inner circumferential surface of the main bearing hole 133*a* is provided with a main bearing 171 configured as a bush bearing inserted thereinto. The main bearing 171 is provided with the main bearing portion 133 of the rotation shaft 125 inserted therein to be supported in the radial direction.

The scroll accommodating portion 134 may be defined as a space formed by the lower surface of the frame disk portion 131 and an inner circumferential surface of the frame side wall portion 132. The orbiting disk portion 151 of the orbiting scroll 150 to be described later is supported in the axial direction by the lower surface of the frame disk portion 131, and an outer circumferential surface of the orbiting disk portion 151 is accommodated in the frame side wall portion 132 with being spaced apart from the inner circumferential surface of the frame side wall portion 132 by a predetermined distance (e.g., orbiting radius). Accordingly, the inner diameter of the frame side wall portion 132 forming the scroll accommodating portion 134 may be larger than an outer diameter of the orbiting disk portion 151 by more than the orbiting radius.

A height (or depth) of the frame side wall portion 132 forming the scroll accommodating portion 134 may be greater than or equal to a thickness of the orbiting disk portion 151. Accordingly, the orbiting scroll 150 may rotate inside the scroll accommodating portion 134 while the frame side wall portion 132 is supported on an upper surface of the fixed scroll 140.

The scroll supporting portion 135 is defined in an annular shape at the lower surface of the frame disk portion 131 facing the orbiting disk portion 151 of the orbiting scroll 150 to be described later. Accordingly, an Oldham ring 180 may be orbitally inserted between an outer circumferential surface of the scroll supporting portion 135 and the inner circumferential surface of the frame side wall portion 132.

Next, the fixed scroll will be described.

Referring to FIG. 2, the fixed scroll 140 according to this embodiment may include a fixed disk portion 141, a fixed side wall portion 142, a sub bearing portion 143, and a fixed wrap 144.

The fixed disk portion 141 may be defined in a shape of a disk with a plurality of concave portions formed along an outer circumferential surface thereof, and a central portion of the fixed disk portion 141 may be provided with the sub bearing hole 143*a* constituting the sub bearing portion 143, to be described later, formed therethrough in a vertical direction. Around the sub bearing hole 143*a*, there may be provided discharge ports 141*a* and 141*b* communicating with a discharge chamber Vd through which compressed refrigerant is discharged to the discharge space S12 of the discharge cover 160, to be described later.

Although not illustrated in the drawings, only one discharge port may be provided to communicate with both a first compression chamber V1 and a second compression chamber V2, to be described later. However, in this embodiment, a first discharge port 141*a* may communicate with the first compression chamber V1 and a second discharge port 141*b* may communicate with the second compression chamber V2. Accordingly, refrigerant compressed in the first compression chamber V1 and refrigerant compressed in the second compression chamber V2 may be independently discharged through its respective discharge port.

The fixed side wall portion 142 may be defined in an annular shape with being extended in the vertical direction from an edge of an upper surface of the fixed disk portion 141. The fixed side wall portion 142 may be coupled to the frame side wall portion 132 of the main frame 130 in the vertical direction.

The fixed side wall portion 142 is provided with a scroll discharge hole (hereinafter, first discharge hole) 142*b* formed therethrough in the axial direction. The first discharge hole 142*b* may be elongated in the circumferential direction, or a plurality of first discharge holes 142*b* may be formed at predetermined intervals in the circumferential direction. Accordingly, a volume of the compression chamber may be secured relative to a same diameter of the fixed scroll 140 by keeping a radial width of the first discharge hole 142*b* to a minimum while securing a discharge area of the first discharge hole 142*b*.

The first discharge hole 142*b* communicates with the second discharge hole 132*a* in a state in which the fixed scroll 140 is coupled to the cylindrical shell 111. Accordingly, the first discharge hole 142*b* forms a refrigerant discharge passage together with the second discharge hole 132*a* described above.

An outer circumferential surface of the fixed side wall portion 142 may be provided with the scroll oil recovery groove (hereinafter, second oil recovery groove) 142*c*. The second oil recovery groove 142*c* communicates with the first oil recovery groove 132*c* provided in the main frame 130 to guide oil recovered through the first oil recovery groove 132*c* to the storage space S11. Accordingly, the first oil recovery groove 132*c* and the second oil recovery groove 142*c* constitute the second oil recovery passage Po2, which is the second recovery passage, together with the oil recovery groove 161*b* of the discharge cover 160 to be described later.

The fixed side wall portion 142 is provided with the suction port 142*a* formed therethrough in the radial direction. Into the suction port 142*a*, an end portion of the refrigerant suction pipe 115 formed through the cylindrical shell 111 is inserted. Accordingly, refrigerant may be introduced into the compression chamber V through the refrigerant suction pipe 115.

The sub bearing portion 143 extends in the axial direction from the central portion of the fixed disk portion 141 toward the discharge cover 160. A central portion of the sub bearing portion 143 is provided with the sub bearing hole 143*a* in a cylindrical shape formed therethrough in the axial direction, and a sub bearing 172 configured as a bush bearing is inserted into an inner circumferential surface of the sub bearing hole 143*a*.

Accordingly, the lower end of the rotation shaft 125 (or bearing portion) may be inserted in the sub bearing portion 143 of the fixed scroll 140 to be supported in the radial direction, and the eccentric portion 1254 of the rotation shaft 125 may be supported in the axial direction on the upper surface of the fixed disk portion 141 forming a periphery of the sub bearing portion 143.

The fixed wrap 144 may extend in the axial direction from the upper surface of the fixed disk portion 141 toward the orbiting scroll 150. The fixed wrap 144 is engaged with the orbiting wrap 152 to form the compression chamber V to be described later. The fixed wrap 144 will be described later together with the orbiting wrap 152.

Next, the orbiting scroll will be described.

Referring to FIG. 2, the orbiting scroll 150 according to this embodiment includes the orbiting disk portion 151, the orbiting wrap 152, and the rotation shaft coupling portion 153.

The orbiting disk portion 151 is defined in a shape of a disk and is accommodated in the scroll accommodating portion 134 of the main frame 130. The upper surface of the orbiting disk portion 151 may be supported in the axial direction by the scroll supporting portion 135 of the main frame 130 with a back pressure sealing member (not illustrated) interposed therebetween.

The orbiting wrap 152 may extend from the lower surface of the orbiting disk portion 151 toward the fixed scroll 140. The orbiting wrap 152 is engaged with the fixed wrap 144 to form the compression chamber V.

The orbiting wrap 152 may be defined in an involute shape together with the fixed wrap 144. However, the orbiting wrap 152 and the fixing wrap 144 may be defined in various shapes in addition to the involute shape.

For example, the orbiting wrap 152 may be formed in a shape in which a plurality of arcs having different diameters and origins are connected, and an outermost curve thereof may be formed in a substantially elliptical shape having a major axis and a minor axis. The fixed wrap 144 may be formed in a similar manner.

An inner end portion of the orbiting wrap 152 may be provided at a central portion of the orbiting disk portion 151, and the central portion of the orbiting disk portion 151 may be provided with the rotation shaft coupling portion 153 formed therethrough in the axial direction.

The rotation shaft coupling portion 153 is provided with the eccentric portion 1254 of the rotation shaft 125 rotatably inserted thereinto. Accordingly, an outer circumferential portion of the rotation shaft coupling portion 153 is connected to the orbiting wrap 152 to form the compression chamber V together with the first wrap 144 during a compression process.

The rotation shaft coupling portion 153 may have a height overlapping the orbiting wrap 152 on a same plane. In other words, the rotation shaft coupling portion 153 may be disposed at a height where the eccentric portion 1254 of the rotation shaft 125 overlaps the orbiting wrap 152 on a same plane. Accordingly, a repulsive force and a compressive force of refrigerant offset each other while being applied to the same plane with respect to the orbiting disk portion 151, thereby preventing an inclination of the orbiting scroll 150 due to an action of the repulsive force and the compressive force.

An eccentric portion bearing 173 configured as a bush bearing is inserted into an inner circumferential surface of the rotation shaft coupling portion 153. The eccentric portion 1254 of the rotation shaft 125 is rotatably inserted into the eccentric portion bearing 173. Accordingly, the eccentric portion 1254 of the rotation shaft 125 is supported in the radial direction by the eccentric portion bearing 173 to smoothly rotate with respect to the orbiting scroll 150.

Meanwhile, the compression chamber V is provided in a space formed by the fixed disk portion 141 and the fixed wrap 144, and by the orbiting disk portion 151 and the orbiting wrap 152. In addition, the compression chamber V may include the first compression chamber V1 provided between an inner surface of the fixed wrap 144 and an outer surface of the orbiting wrap 152, and the second compression chamber V2 provided between an outer surface of the fixed wrap 144 and an inner surface of the orbiting wrap 152.

Next, the discharge cover will be described.

Referring to FIG. 2, the discharge cover 160 includes a cover housing portion 161 and a cover flange portion 162.

Inside the cover housing portion 161, there is provided a cover space portion 161*a* forming a discharge space S3 together with a lower surface of the fixed scroll 140.

An outer circumferential surface of the cover housing portion 161 is closely adhered to an inner circumferential surface of the casing 110, but a part of the outer circumferential surface of the cover housing portion 161 is spaced apart from the inner circumferential surface of the casing 110 in the circumferential direction to form the oil recovery groove 161*b*. The oil recovery groove 161*b* forms a third oil recovery groove in the oil recovery groove 162*a* formed on an outer circumferential surface of the cover flange portion 162, and the third oil recovery groove of the discharge cover 160 forms the second oil recovery passage Po2 forming the second recovery passage together with the first oil recovery groove of the main frame 130 and the second oil recovery groove of the fixed scroll 140 described above.

An inner circumferential surface of the cover housing 161 may be provided with at least one discharge hole receiving groove 161*c* in the circumferential direction. The discharge hole receiving groove 161*c* may be recessed in the radial direction to face outside, and the first discharge hole 142*b* of the fixed scroll 140 forming the discharge passage may be located inside the discharge hole receiving groove 161*c*. Accordingly, the inner surface of the cover housing 161 excluding the discharge hole receiving groove 161*c* is closely adhered to an outer circumferential surface of the fixed scroll 140, namely, an outer circumferential surface of the fixed disk portion 141 to form a type of sealing portion.

A total circumferential angle of the discharge hole receiving grooves 161*c* may be smaller than or equal to a total circumferential angle of an inner circumferential surface of the discharge space S3 excluding the discharge hole receiving grooves 161*c*. Accordingly, the inner circumferential surface of the discharge space S3 excluding the discharge hole receiving grooves 161*c* may secure a sufficient sealing area.

The cover flange portion 162 may extend in the radial direction from a portion forming the sealing portion, that is, an outer circumferential surface of a portion of an upper end surface of the cover housing portion 161 except for the discharge hole receiving groove 161*c*.

The cover flange portion 162 may be provide with fastening holes (not illustrated) to fasten the discharge cover 160 to the fixed scroll 140 by bolts, and a plurality of oil recovery grooves 162*a* may be formed to be recessed in the radial direction between the fastening holes at predetermined intervals. The oil recovery groove forms the third oil recovery groove together with the oil recovery groove 161*b* of the cover housing portion 161 described above.

In the drawings, unexplained reference numeral 21 denotes a condenser fan, and 41 denotes an evaporator fan.

The scroll compressor according to this embodiment may operate as follows.

When power is applied to the driving motor 120, a rotational force is generated, and the rotor 122 and the rotation shaft 125 rotate by the rotational force. Accordingly, the orbiting scroll 150 eccentrically coupled to the rotation shaft 125 rotates with respect to the fixed scroll 140 by the Oldham ring 180.

A volume of the compression chamber V gradually decreases in an order of a suction pressure chamber Vs at an outer side of the compression chamber V, an intermediate pressure chamber Vm, and a discharge pressure chamber Vd at a central portion of the compression chamber V.

Refrigerant moves to the condenser 20, the expander 30, and the evaporator 40 of the refrigeration cycle to move to the accumulator 50. The refrigerant then moves to the suction chamber Vs forming the compression chamber V through the refrigerant suction pipe 115.

The refrigerant sucked into the suction chamber Vs is compressed while moving to the discharge chamber Vd through the intermediate pressure chamber Vm along a movement trajectory of the compression chamber V, and the compressed refrigerant is discharged from the discharge chamber Vd to the discharge space S12 of the discharge cover 160 through the discharge ports 141*a* and 141*b*.

Then, the refrigerant (Oil is mixed in the refrigerant to form mixed refrigerant. However, the term "mixed refrigerant" and "refrigerant" will be used equally in the description.) discharged to the discharge space S12 of the discharge cover 160 moves to the discharge space S12 formed between the main frame 130 and the driving motor 120 through the discharge hole receiving groove 161*c* of the discharge cover 160 and the first discharge hole 142*b* of the fixed scroll 140. The mixed refrigerant passes through the driving motor 120 to move to the upper space S2 of the casing 110 formed above the driving motor 120.

The mixed refrigerant moved to the upper space S2 is separated into refrigerant and oil in the upper space S2, and the refrigerant (or some mixed refrigerant in which oil is not separated therefrom) is discharged outwardly of the casing 110 through the refrigerant discharge pipe 116 to move to the condenser 20 of the refrigeration cycle.

Meanwhile, the oil separated from the refrigerant in the upper space S2 (or mixed oil in which liquid refrigerant is mixed) moves to the lower space S1 through the first oil recovery passage formed between the inner circumferential surface of the casing 110 and the stator 121. The oil is then recovered in the storage space S11 provided under the compression portion through the second oil recovery passage Po2 formed between the inner circumferential surface of the casing 110 and the outer circumferential surface of the compression portion.

The oil is then supplied to each bearing surface (not illustrated) through the oil supply passage 126, and part of the oil is supplied to the compression chamber V. The oil supplied to the bearing surface and the compression chamber V repeats a series of processes of being discharged to the discharge cover 160 to be recovered together with the refrigerant.

Meanwhile, in the case of the lower compression-type scroll compressor, since refrigerant discharged to the inner space of the casing moves to the discharge pipe located at the upper portion of the casing whereas oil is recovered to the storage space provided under the compression portion, there is a concern that the oil may be mixed in the refrigerant to be discharged outwardly of the compressor or may be pushed by a pressure of the refrigerant to be stagnated at an upper side of the motor portion.

In this regard, the flow path guide may be installed between a lower end of the driving motor and an upper end of the compression portion forming the discharge space to separate the discharge passage of the refrigerant moving to the upper space and the recovery passage of the oil moving to the lower space.

However, the related art flow path guide only serves to guide refrigerant (or mixed oil in which refrigerant and oil are mixed) discharged into the discharge space to the passage provided inside the motor portion by dividing the discharge space in the radial direction, and this has a limit in enhancing the oil separation effect by blocking refrigerant from being brought into contact with a rotating body such as the balance weight or the rotor.

According to the present disclosure, a flow path guide is installed in the discharge space, and refrigerant discharged to the discharge space by the flow path guide is in wide contact with a rotating body such as the balance weight or the rotor, thereby enhancing the oil separation effect.

Figure 3:
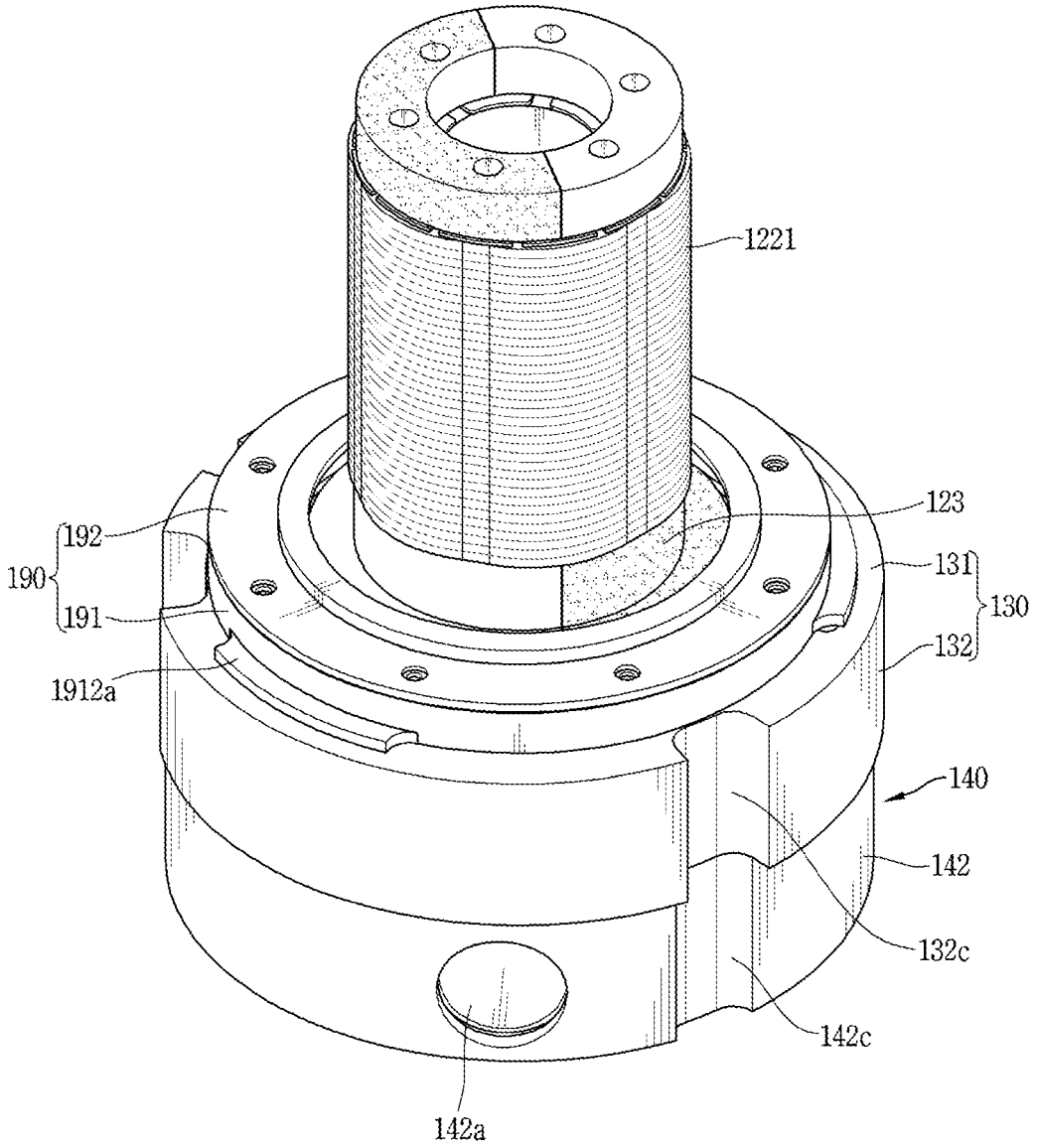
FIG. 3 is a perspective view illustrating a part of a motor portion and a part of a compression portion of FIG. 2.
Figure 4:
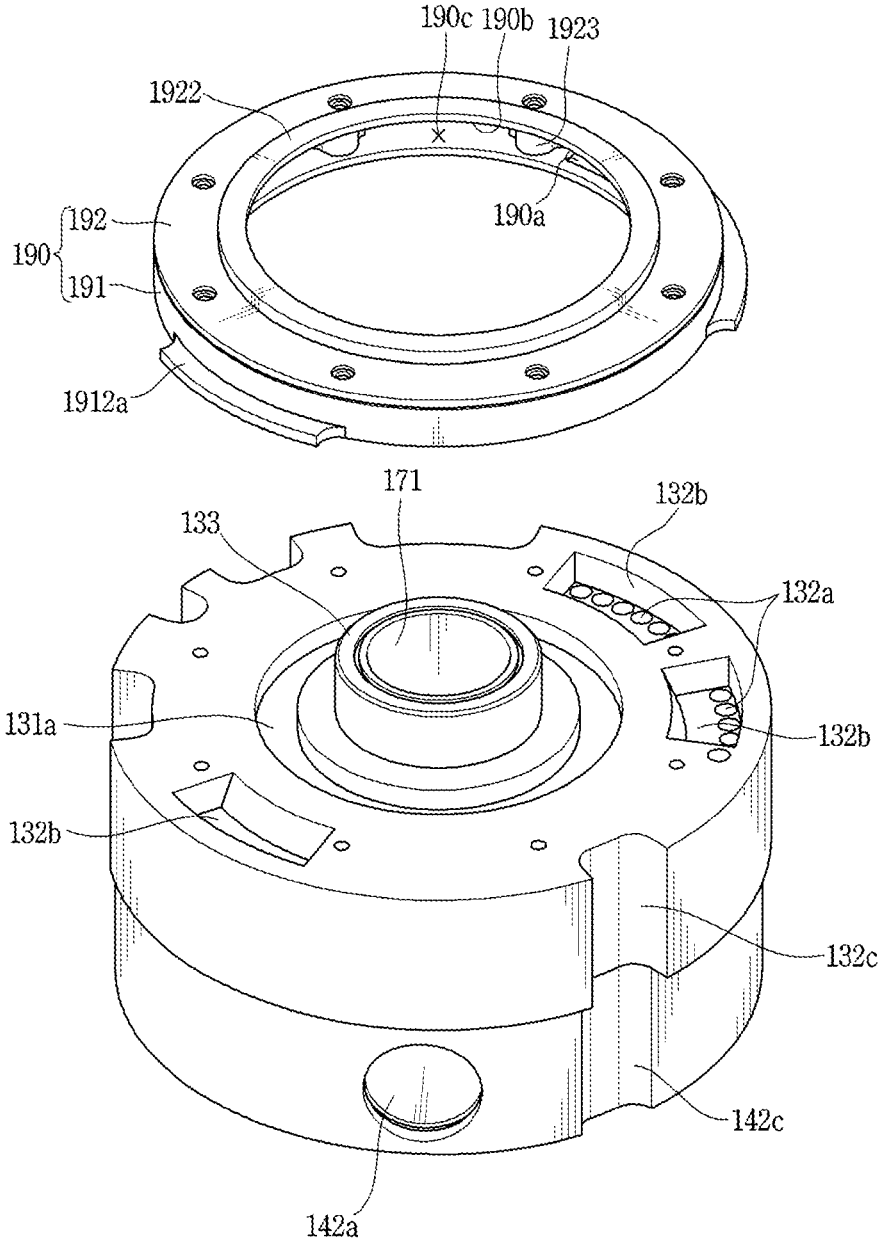
FIG. 4 is an exploded perspective view illustrating a flow path guide separated from the compression portion of FIG. 3.
Figure 5:
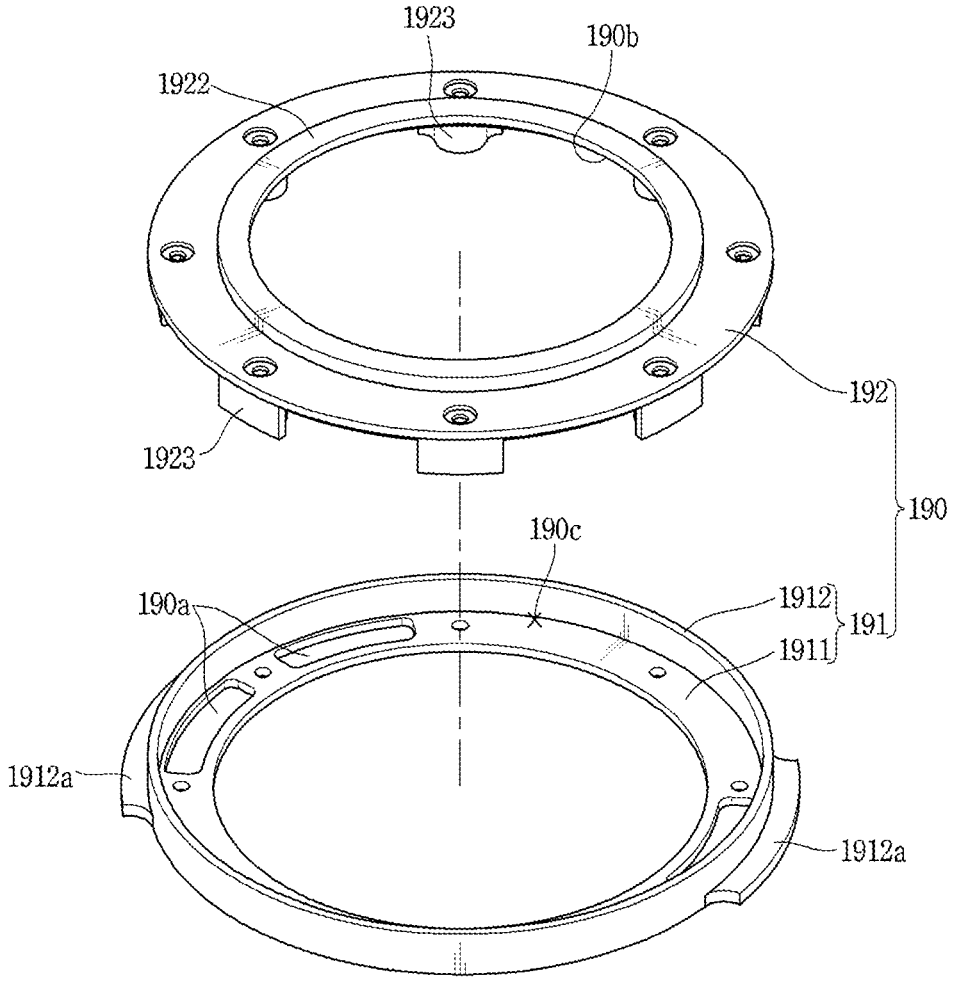
FIG. 5 is an exploded perspective view of a disassembled flow path guide of FIG. 4 viewed from above.
Figure 6:
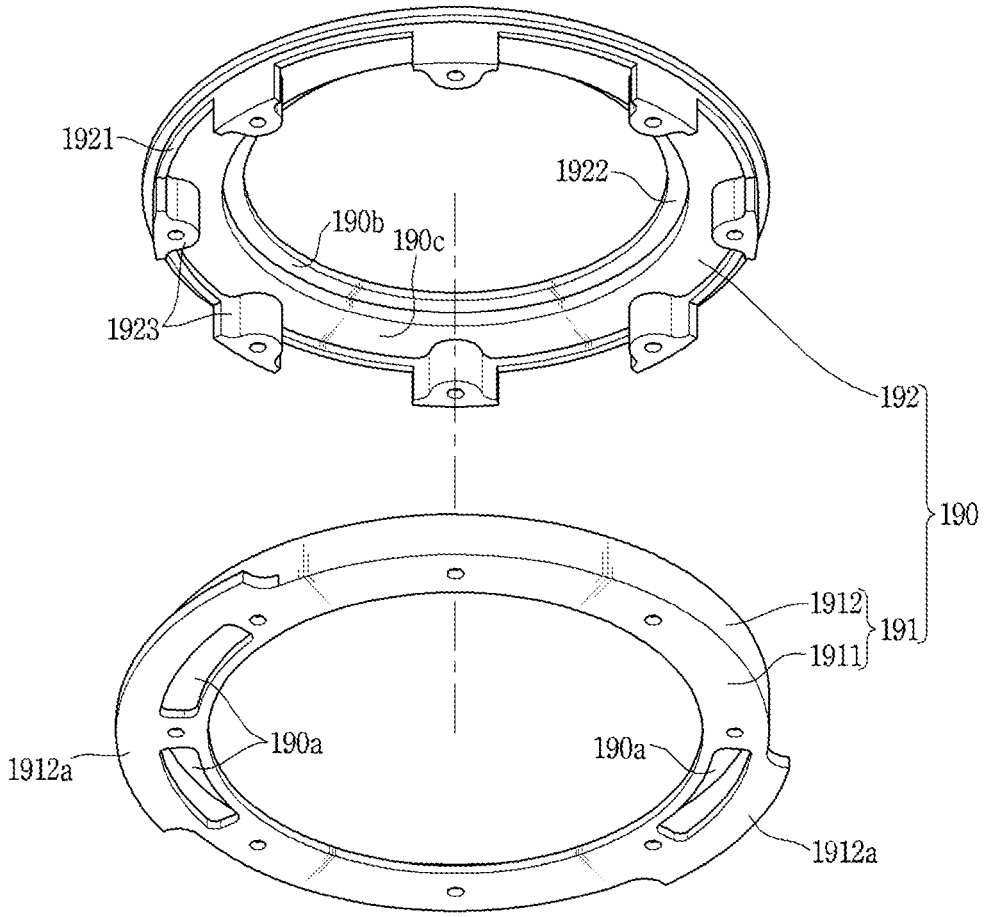
FIG. 6 is an exploded perspective view of the disassembled flow path guide of FIG. 4 viewed from below.
Figure 7:
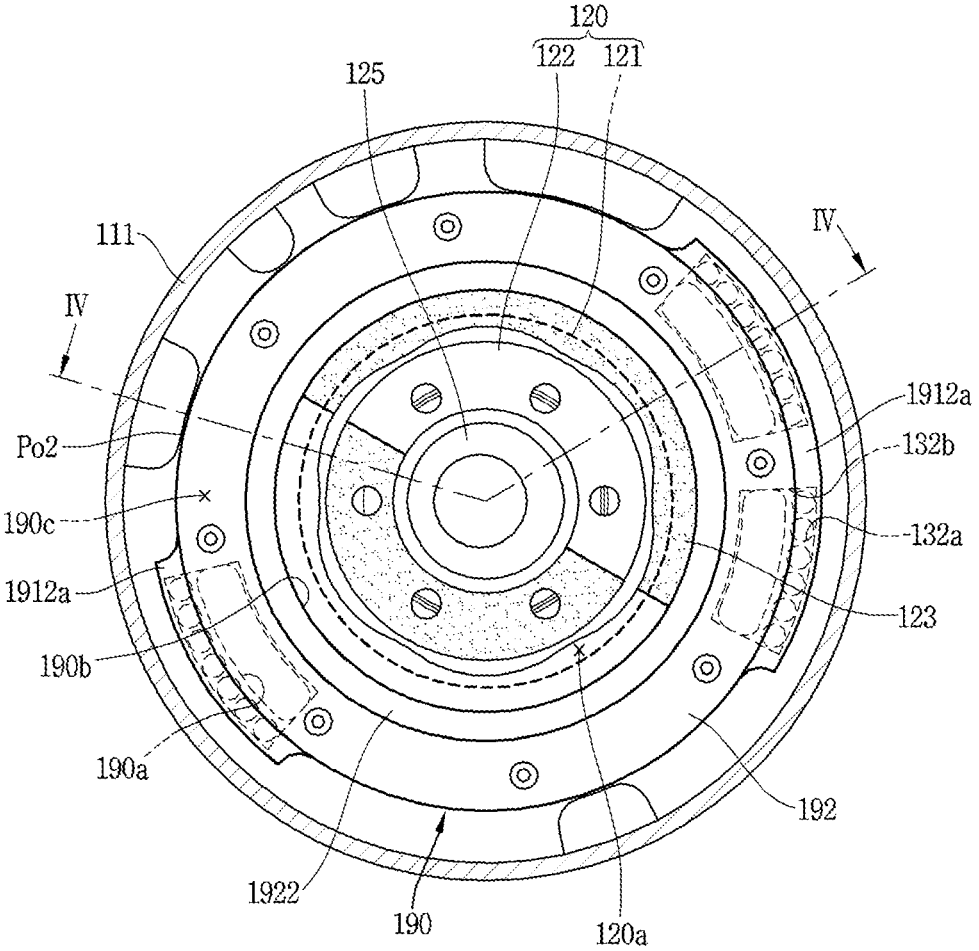
FIG. 7 is a planar view of an assembled flow path guide of FIG. 4 viewed from above.
Figure 8:
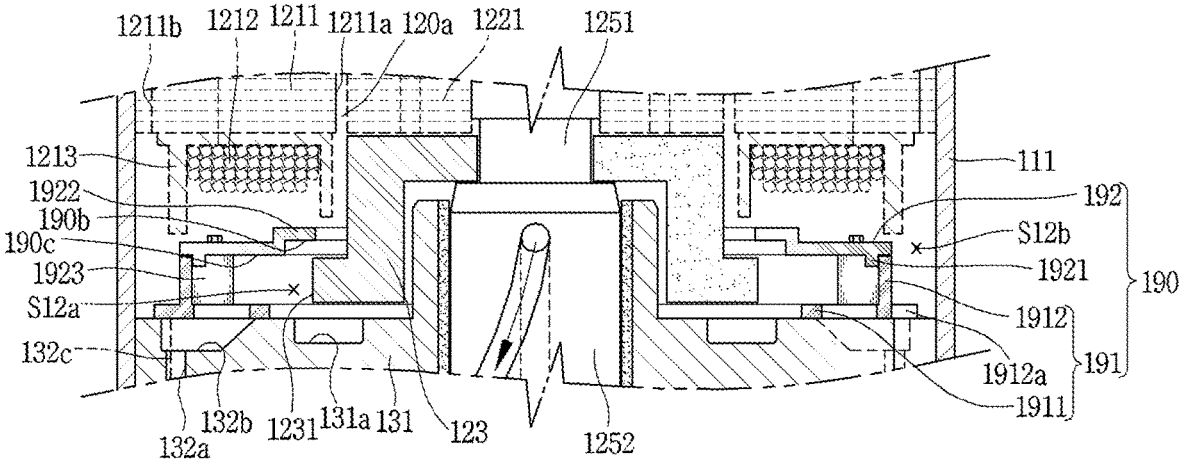
FIG. 8 is a sectional view taken along line "IV-IV" of FIG. 7.
Figure 9:
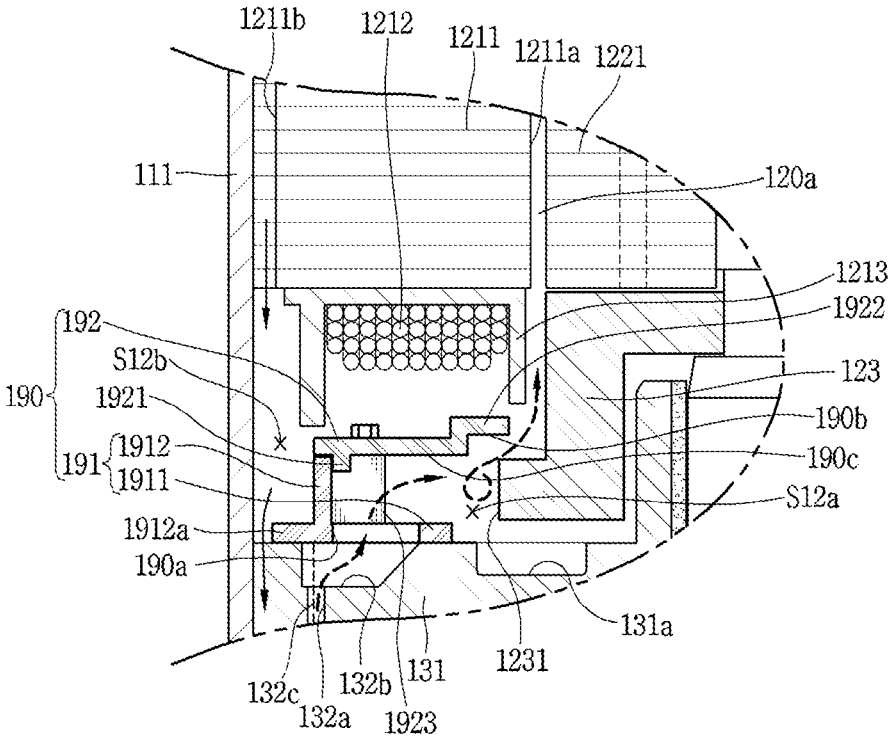
FIG. 9 is an enlarged view illustrating refrigerant passing through a flow path guide of FIG. 8.

FIG. 3 is a perspective view illustrating a part of a motor portion and a part of a compression portion of FIG. 2, FIG. 4 is an exploded perspective view illustrating a flow path guide separated from the compression portion of FIG. 3, FIG. 5 is an exploded perspective view of a disassembled flow path guide of FIG. 4 viewed from above, FIG. 6 is an exploded perspective view of the disassembled flow path guide of FIG. 4 viewed from below, FIG. 7 is a planar view of an assembled flow path guide of FIG. 4 viewed from above, FIG. 8 is a sectional view taken along line "IV-IV"

of FIG. 7, and FIG. 9 is an enlarged view illustrating refrigerant passing through a flow path guide of FIG. 8.

Referring to FIGS. 3 to 9, the flow path guide 190 according to this embodiment is defined in a ring shape with a central portion thereof being opened. For example, the flow path guide 190 may include a lower plate guide 191 and an upper plate guide 192 coupled to an upper end of the lower plate guide 191.

The lower plate guide 191 may be closely coupled to the upper surface of the compression portion, namely, an upper surface of the main frame 130, and the upper plate guide 192 may be coupled to the upper end of the lower plate guide 191 to cover an upper surface of the lower plate guide 191. The upper plate guide 192 may be spaced apart from a lower end of the driving motor 120, namely, the insulator (or winding coil) 1213 by a predetermined distance. However, the upper plate guide 192 may be closely adhered to or overlap the insulator 1213.

The lower plate guide 191 according to this embodiment includes a bottom portion 1911 and an outer wall portion 1912 extending from the bottom portion 1911 toward the driving motor 120 and spaced apart in the radial direction. The bottom portion 1911 and the outer wall portion 1912 may be formed as a single body, or may be post-assembled.

The bottom portion 1911 is defined in a ring shape, and a bottom surface of the bottom portion 1911 may be closely coupled to the upper surface of the main frame 130 forming the upper surface of the compression portion. The bottom surface of the bottom portion 1911 may be flat, and the upper surface of the main frame 130 facing the bottom surface of the bottom portion 1911 may also be flat. Accordingly, the discharge space S12 may be divided into an inner side space S12*a* and an outer side space S12*b* by the lower plate guide 191, and the inner side space S12*a* at an inner circumferential side of the lower plate guide 191 may be separated from the first oil recovery groove 132*c* forming the second recovery passage at the outer circumferential side of the lower plate guide 191.

However, on the upper surface of the main frame 130 adjacent to an inner circumferential side of the bottom portion 1911, there may be formed an oil receiving groove 131*a* to receive oil separated from liquid refrigerant or gas refrigerant in the discharge space S12, or liquid refrigerant mixed in oil. The oil receiving groove 131*a* may be defined in an annular or arc shape.

A depth of the oil receiving groove 131*a* may be preferably formed as deep as possible so as to accommodate a large amount of oil or liquid refrigerant. Of the oil or liquid refrigerant accommodated in the oil receiving groove 131*a*, in particular, the liquid refrigerant may be evaporated by motor heat or heat of compression generated during a compression. Accordingly, an amount of leakage of liquid refrigerant or liquid refrigerant and oil may be reduced.

The bottom portion 1911 may have at least one guide inlet 190*a* formed in the circumferential direction. When provided with a plurality of guide inlets 190*a*, the guide inlets 190*a* may be formed at predetermined intervals in the circumferential direction.

The guide inlet 190*a* may communicate with the second discharge hole 132*a* provided in the main frame 130. For example, the upper surface of the main frame 130 may have a discharge guide groove 132*b* receiving the second discharge hole 132*a* as described above, and the guide inlet 190*a* may communicate with the discharge guide groove 132*b*.

The discharge guide groove 132*b* is formed to be wider in the radial direction than the second discharge hole 132*a*. Accordingly, the bottom portion 1911 is coupled while covering about half of the discharge guide groove 132*b*. In other words, the bottom portion 1911 may cover the discharge guide groove 132*b* from an inner circumferential side up to a middle in the radial direction, but may not cover from the middle to an outer circumferential side of the discharge guide groove 132*b*.

With this reason, a discharge passage covering portion 1912*a* may be formed to extend in the radial direction from an outer circumferential surface of the outer wall portion 1912. The discharge passage covering portion covers a portion of the outer circumferential side of the discharge guide groove 132*b* not covered by the bottom portion 1911. Accordingly, refrigerant (or mixed refrigerant) moving to the discharge guide groove 132*b* through the second discharge hole 132*a* is discharged to the inner side of the flow path guide 190, namely, an inner side of the outer wall portion 1912 through the guide inlet 190*a* without being leaked to the outer side of the flow path guide 190, namely, an outer side of the outer wall portion 1912.

The outer wall portion 1912 may be formed at the lower plate guide 191 or at the upper plate guide 192. This embodiment will be described with reference to an example in which the outer wall portion 1912 is formed at the lower plate guide 191.

The outer wall portion 1912 is defined in an annular shape. The outer wall portion 1912 is coupled to cross between the outer circumferential surface and the inner circumferential surface of the discharge guide groove 132*b* in the circumferential direction. As described above, since the discharge passage covering portion 1912*a* extends from the outer circumferential surface of the outer wall portion 1912, a portion of the discharge guide groove 132*b* located on the outer side of the flow path guide 190 may be covered. This may suppress refrigerant from being discharged outwardly of the flow path guide 190.

A height of the outer wall portion 1912 may be substantially similar to a distance between the upper surface of the compression portion and the lower end of the driving motor 120 facing the upper surface of the compression portion. Accordingly, the upper plate guide 192 covering an upper end of the outer wall portion 1912 or the outer wall portion 1912 may be disposed close to the insulator 1213 forming a portion of the driving motor 120 or may overlap the insulator 1213 in the axial direction.

In addition, the height of the outer wall portion 1912 is directly related to a height of a guide passage 190*c* connecting the guide inlet 190*a* and the guide outlet 190*b*. And, the height of the guide passage 190*c* is related to a shape of the balance weight 123.

For example, when a mass portion 1231 is defined in a flange shape on a lower outer circumferential surface of the balance weight 123, the height of the outer wall portion 1912 should be greater than a thickness (or axial height) of the mass portion 1231 of the balance weight 123. Accordingly, even if the flow path guide 190 overlaps the air gap 120*a* of the driving motor 120 or extends to a position close to the air gap 120*a*, the guide outlet 190*b* of the flow path guide 190 is not blocked by the mass portion 1231 of the balance weight 123, and therefore, an area of the guide outlet 190*b* may be properly secured.

The upper plate guide 192 according to this embodiment may be coupled to the upper end of the outer wall portion 1912 of the lower plate guide 191. The upper plate guide 192 may be defined in an annular shape, and provided with an insertion protrusion 1921 at a lower surface of an edge thereof facing the outer wall portion 1912 of the lower plate guide 191. The insertion protrusion 1921 may be defined in an annular shape or formed to connect between support ribs 1923, to be described later, and may be press-fitted or tightly inserted into an upper inner circumferential surface of the lower plate guide 191.

The upper plate guide 192 may be defined in a shape of a disk. However, the upper plate guide 192 may be defined in various shapes according to the shape of the balance weight 123. For example, when the balance weight 123 is defined in a simple cylindrical or semi-cylindrical shape, the upper plate guide 192 may be defined in a flat plate shape.

However, as described above, when the mass portion 1231 extends in a flange shape from the lower outer circumferential surface of the balance weight 123, there may be provided a weight accommodating portion 1922 bent upwardly by the thickness (or axial height) or equivalent thereto of the mass portion 1231. Accordingly, even if the mass portion 1231 is further provided on the lower outer circumferential surface of the balance weight 123, an axial distance between the mass portion 1231 and the upper plate guide 192 may be maintained, thereby securing an area of the guide outlet 190*b* enough to suppress a flow resistance of refrigerant.

An outer end of the upper plate guide 192 is closely coupled to the outer wall portion 1912 of the lower plate guide 191, while an inner end of the upper plate guide 192 is axially spaced apart from the bottom portion 1911 of the upper plate guide 192. Accordingly, a space between the lower plate guide 191 and the upper plate guide 192, namely, the guide passage 190*c* is formed such that an outer circumferential surface thereof is closed and an inner circumferential surface thereof is opened to have the guide outlet 190*b* at the inner end of the upper plate guide 192.

Here, the upper plate guide 192 may be fixed to an outer circumferential surface of the lower plate guide 191 using the insertion protrusion 1921 described above. However, at least one of the lower plate guide 191 and the upper plate guide 192 may be provided with support ribs 1923 protruding in the axial direction toward a plate guide on an opposite side thereof. This embodiment illustrates an example in which the support ribs 1923 are provided on the upper plate guide 192.

The support rib 1923 may be provided in plural to be spaced apart at predetermined intervals in the circumferential direction. A bolt hole (not illustrated) may be formed in the support rib 1923 so that a fastening bolt (not illustrated) to fasten the upper plate guide 192 and the lower plate guide 191 to the main frame 130 passes therethrough. Accordingly, the flow path guide 190 formed by the lower plate guide 191 and the upper plate guide 192 is firmly fixed to the main frame 130 while maintaining a constant gap between the lower plate guide 191 and the upper plate guide 192, to thereby allow refrigerant to be discharged smoothly.

The guide outlet 190*b* may be defined in an annular or arc shape. However, it is preferable that the guide outlet 190*b* is defined in an annular shape to reduce a flow resistance.

The guide outlet 190*b* may be located closer to the rotation shaft 125 than the guide inlet 190*a*. Since the guide outlet 190*b* is located at a position significantly closer to a center compared to the guide inlet 190*a*, refrigerant may be guided toward the air gap 120*a*.

The guide outlet 190*b* may be opened in a direction toward the rotation shaft 125, namely, in the radial direction. Specifically, the guide outlet 190*b* may be formed at a position overlapping the outer circumferential surface of the balance weight 123 in the axial direction. Accordingly, refrigerant discharged from the guide outlet 190*b* is directly guided toward the balance weight 123 to be stirred by the balance weight 123, thereby improving the oil separation effect in which oil is separated from gas refrigerant or liquid refrigerant.

The guide outlet 190*b* may be formed in a manner that at least a portion thereof overlaps the air gap 120*a* of the driving motor 120 in the radial direction. For example, the guide outlet 190*b* may be located closer to the rotation shaft 125 than an outer circumferential surface of a bundle of coils in which the stator coils 1212 are wound, at a lower end of the stator core 1211.

Specifically, the guide outlet 190*b* may be located closer to the rotation shaft 125 than the inner circumferential surface of the bundle of coils in which the stator coils 1212 are wound, or located on a same axis line as the inner circumferential surface of the bundle of coils. Accordingly, as the guide outlet 190*b* is located at a minimum distance from the air gap 120*a*, refrigerant discharged through the guide outlet 190*b* may not move toward a slit (or inner passage) where the stator coil 1212 is wound, but move toward the air gap (or air gap passage) 120*a*.

However, in this case, the outer circumferential surface of the balance weight 123 excluding the mass portion 1231 may be located adjacent to the rotation shaft 125 rather than to the air gap 120*a*, or at least the outer circumferential surface of the balance weight 123 may be located on a substantially same axis line as the air gap 120*a*. Accordingly, refrigerant discharged through the guide outlet 190*b* may collide with the balance weight 123 to be stirred before moving directly to the air gap 120*a*, and then move to the air gap 120*a*.

The flow path guide according to this embodiment as described above has the following effects.

Refrigerant is discharged from the compression chamber V of the compression portion to the discharge space S3 of the discharge cover 160, and moves to the discharge guide groove 132*b* through the first discharge hole 142*b* and the second discharge hole 132*a*. The refrigerant is then introduced into the guide passage 190*c* through the guide inlet 190*a* of the flow path guide 190, moved along the guide passage 190*c*, and then discharged to the discharge space S12, particularly, the inner side space S12*a* through the guide outlet 190*b* provided at the inner circumferential side of the flow path guide 190.

Here, as the guide outlet 190*b* is blocked in the axial direction by the upper plate guide 192, the guide outlet 190*b* is located at a position close to the air gap 120*a* or to the balance weight 123. With this reason, the refrigerant moves to the air gap 120*a* heading towards the balance weight rather than flowing toward the inner passage formed by the slits of the stator core 1211.

Then, most of the refrigerant discharged from the guide outlet 190*b* toward the discharge space S12 moves in the radial direction to be brought into contact with the outer circumferential surface of the balance weight 123 facing the guide outlet 190*b* or to be gathered around the balance weight 123. Here, as the balance weight 123 rotates at a high speed, the refrigerant in contact with or gathered around the balance weight 123 is stirred by the balance weight 123 or rotated by receiving a strong rotational force in the circumferential direction. In this process, gas refrigerant or liquid refrigerant is separated from oil as refrigerant particles collide with each other.

Then, the liquid refrigerant and oil separated from the gas refrigerant remain in the discharge space S12, so that the liquid refrigerant is vaporized by motor heat or the like, while the oil is recovered to the storage space S11 through a gap between members. In addition, separated gas refrigerant, and liquid refrigerant not separated from gas refrigerant or refrigerant in a droplet state containing oil are blocked from moving to the inner passage formed by the slits due to the flow path guide 190, but allowed to move toward the air gap 120*a* to be discharged to the upper space S2 of the casing 110 through the air gap 120*a*.

Here, the refrigerant in a droplet state introduced into the air gap 120*a* is stirred by receiving a centrifugal force by a rotational force of the rotor 122, and at the same time, strongly rotates by receiving the centrifugal force as being discharged to the upper space S2. Accordingly, while or after the refrigerant passes through the air gap 120*a* of the driving motor 120, oil is separated again from the gas refrigerant and the liquid refrigerant in the upper space S2. The liquid refrigerant separated from the oil is rapidly vaporized to be converted into gas refrigerant.

Then, the gas refrigerant moves toward the condenser 20 through the refrigerant discharge pipe 116, while the oil separated from the gas refrigerant moves along the inner circumferential surface of the casing 110 to be recovered in the storage space S11 through the first oil recovery passage Po1 forming the first recovery passage and the second oil recovery passage Po2 forming the second recovery passage.

In this way, most of the refrigerant discharged to the discharge space through the flow path guide is moved toward the air gap to enhance the oil separation effect. And therefore, a leakage of liquid refrigerant or oil together with gas refrigerant to the outside of the compressor is minimized to suppress a friction loss or damage caused by abrasion in the compressor.

In addition, as the outlet of the flow path guide is disposed adjacent to the balance weight, refrigerant discharged to the discharge space is stirred by the balance weight to receive a centrifugal force, thereby enhancing the oil separation effect in the discharge space.

In addition, as the outlet of the flow path guide is disposed adjacent to or to face the air gap between the stator and the rotor of the motor portion, refrigerant discharged through the outlet of the flow path guide may be guided to the balance weight or to the air gap without flowing into the inner passage of the motor portion. Accordingly, the refrigerant discharged to the discharge space receives a centrifugal force by the balance weight and the rotor, to thereby improve the oil separation effect.

In addition, since the oil is effectively separated from the liquid refrigerant or gas refrigerant inside the compressor during a normal operation, the air conditioner may quickly start a cooling operation or a heating operation.

Hereinafter, description will be given of another embodiment of the flow path guide.

In the above-described embodiment, the guide passage connecting the guide inlet and the guide outlet is defined in an annular shape with an edge thereof forming a right angle, but in some cases, the edge of the guide passage may be formed to be inclined or curved.

Figure 10:
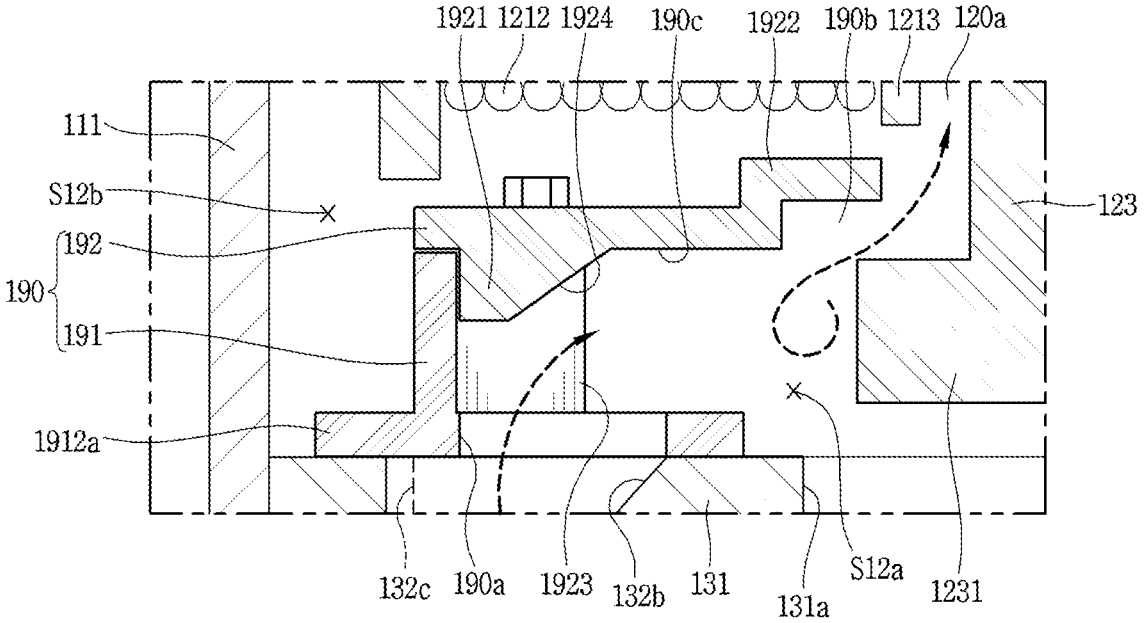
FIG. 10 is a sectional view illustrating another embodiment of a flow path guide of FIG. 9.

FIG. 10 is a sectional view illustrating another embodiment of the flow path guide.

Referring to FIG. 10, a guide surface may be provided at the outer wall portion 1912 of the lower plate guide 191 forming an edge of the guide passage 190*c* or at the inner surface of the upper plate guide 192 (specifically, the insertion protrusion) from the guide inlet 190*a* toward the guide outlet 190*b*. In this embodiment, the guide surface 1924 is provided on the inner circumferential surface of the insertion protrusion 1921.

The guide surface 1924 may be formed to be inclined or curved in a forward direction with respect to a flow direction of refrigerant, that is, in a direction getting closer to the rotation shaft 125 upwardly. Accordingly, refrigerant moving from the guide inlet 190*a* to the guide outlet 190*b* may suppress a creation of a vortex at the inner circumferential surface forming the edge of the guide passage 190*c*. Then, the refrigerant may move more smoothly from the guide inlet 190*a* toward the guide outlet 190*b*.

The guide surface 1924 as described above may be equally applied to a portion forming an edge, regardless of the shape of the flow path guide 190.

Hereinafter, description will be given of still another embodiment of the flow path guide.

That is, in the above-described embodiments, the outer wall portion is provided at an outer circumferential side of the bottom portion of the lower plate guide, but in some cases, the inner wall portion may be further provided at an inner circumferential side of the bottom portion of the lower plate guide.

Figure 11:
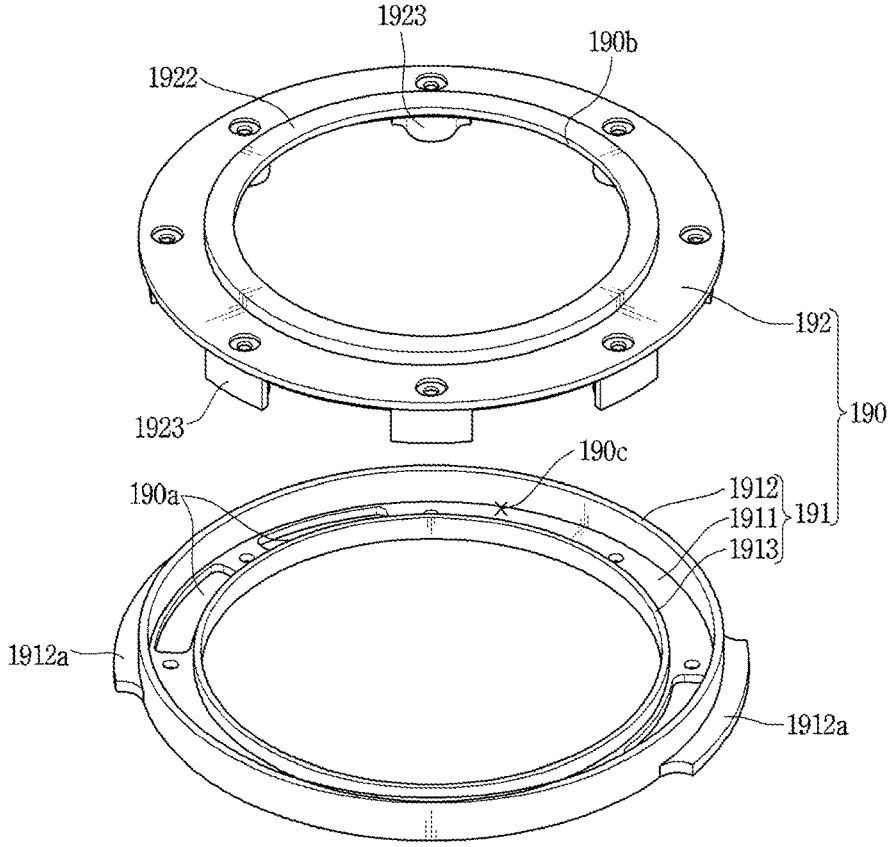
FIG. 11 is an exploded perspective view and FIG. 12 is an assembled sectional view illustrating still another embodiment of a flow path guide.
Figure 12:
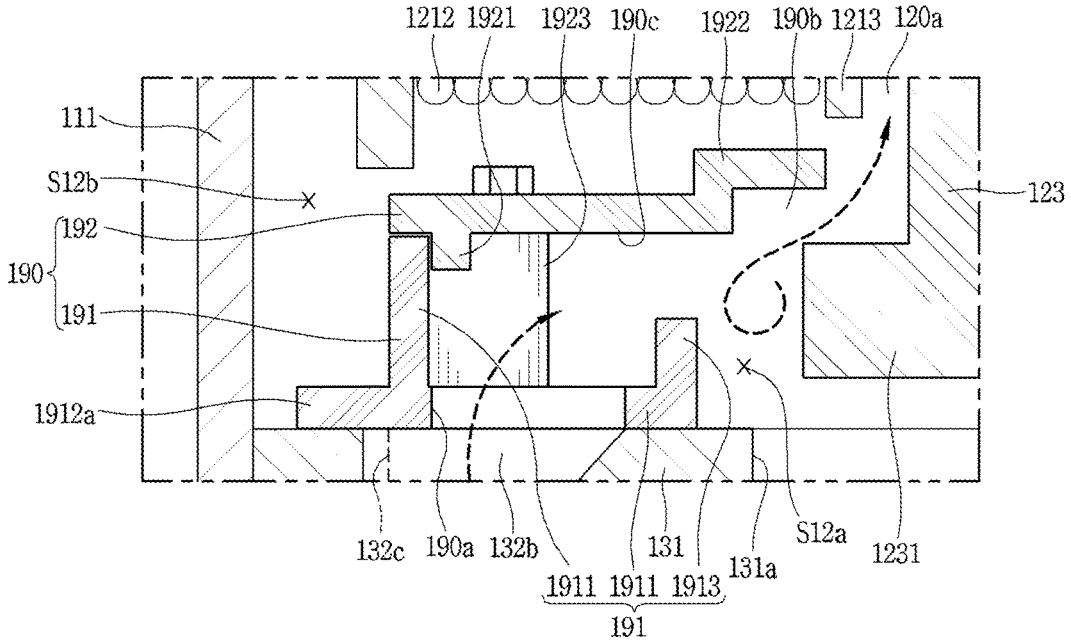

FIG. 11 is an exploded perspective view and FIG. 12 is an assembled sectional view illustrating still another embodiment of the flow path guide.

Referring to FIGS. 11 and 12, the flow path guide 190 according to this embodiment may include the lower plate guide 191 and the upper plate guide 192. Since the upper plate guide 192 is the same as that of the embodiment of FIG. 3, a description thereof will be replaced with the description of the above embodiment. The lower plate guide 191 may include the bottom portion 1911, the outer wall portion 1912, and the inner wall portion 1913. Since the bottom portion 1911 and the outer wall portion 1912 are the same as those of the above-described embodiment of FIG. 3, a description thereof will be replaced with the description of the above-described embodiment.

The inner wall portion 1913 may extend toward the driving motor 120 from an upper surface of the inner circumferential side of the bottom portion 1911. The inner wall portion 1913 may be located as close to the rotation shaft 125 as possible, but may preferably have an appropriate distance from the balance weight 123. Accordingly, the inner side space S12*a* at an inner circumferential surface of the inner wall portion 1913 may secure an appropriate volume.

The inner wall portion 1913 may be located radially farther from the rotation shaft 125 than an inner circumferential end of the upper plate guide 192 or may be located at least on a same line as the inner circumferential end of the upper plate guide 192 in the axial direction. Accordingly, a sufficient space in which oil is separated from gas refrigerant and liquid refrigerant by being stirred by the balance weight 123 may be secured.

A height of the inner wall portion 1913 may be lower than a height of the outer wall portion 1912. For example, the height of the inner wall portion 1913 may be lower than a height of the mass portion 1231 of the balance weight 123.

Specifically, the height of the inner wall portion 1913 may be sufficient to cover a part of a lower portion of the balance weight 123. Here, refrigerant discharged through the guide outlet 190*b* may be mainly stirred by an upper portion of the balance weight 123. Accordingly, the upper end of the inner wall portion 1913 may be spaced apart from the weight accommodating portion 1922 forming the upper plate guide 192 to form the guide outlet 190*b*. Accordingly, refrigerant introduced into the guide passage 190*c* through the guide inlet 190*a* may be smoothly discharged into the discharge space S12 through the guide outlet 190*b*.

In addition, the inner wall portion 1913 may extend in the axial direction. However, the inner wall portion 1913 may be defined in various shapes according to the shape of the balance weight 123 facing the inner wall portion 1913. For example, when the mass portion 1231 extends in a flange shape on the lower outer circumferential surface of the balance weight 123, the weight accommodating portion (not illustrated) accommodating the mass portion 1231 may be formed to be stepped at the inner wall portion 1913. The weight accommodating portion may be formed to correspond to the weight accommodating portion 1922 included in the upper plate guide 192.

As described above, when the inner wall portion 1913 is further provided in the flow path guide 190, the inner wall portion 1913 serves as a partition wall separating between the discharge space S12 and the guide passage 190*c*, which is an inner space of the flow path guide 190. This may suppress oil, separated from liquid refrigerant or gas refrigerant by the balance weight 123, from being introduced back into the guide passage 190*c*, which is the inner space of the flow path guide 190, to thereby prevent the discharge guide groove 132*b* communicating with the guide inlet 190*a* of the flow path guide 190 from being clogged by the oil separated from liquid refrigerant or gas refrigerant.

Hereinafter, description will be given of another embodiment of the flow path guide according to this embodiment.

In the above-described embodiments, the bottom portion is provided on the lower plate guide of the flow path guide, but in some cases, the bottom portion may be excluded from the lower plate guide.

Figure 13:
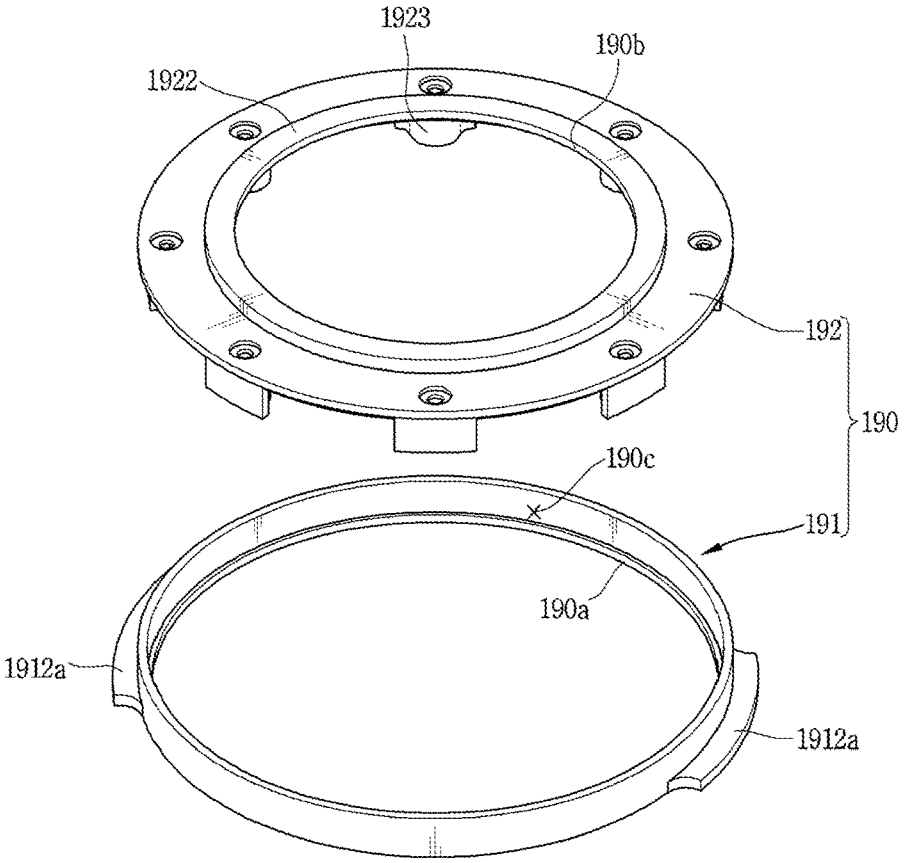
FIG. 13 is an exploded perspective view and FIG. 14 is an assembled sectional view illustrating still another embodiment of a flow path guide.
Figure 14:
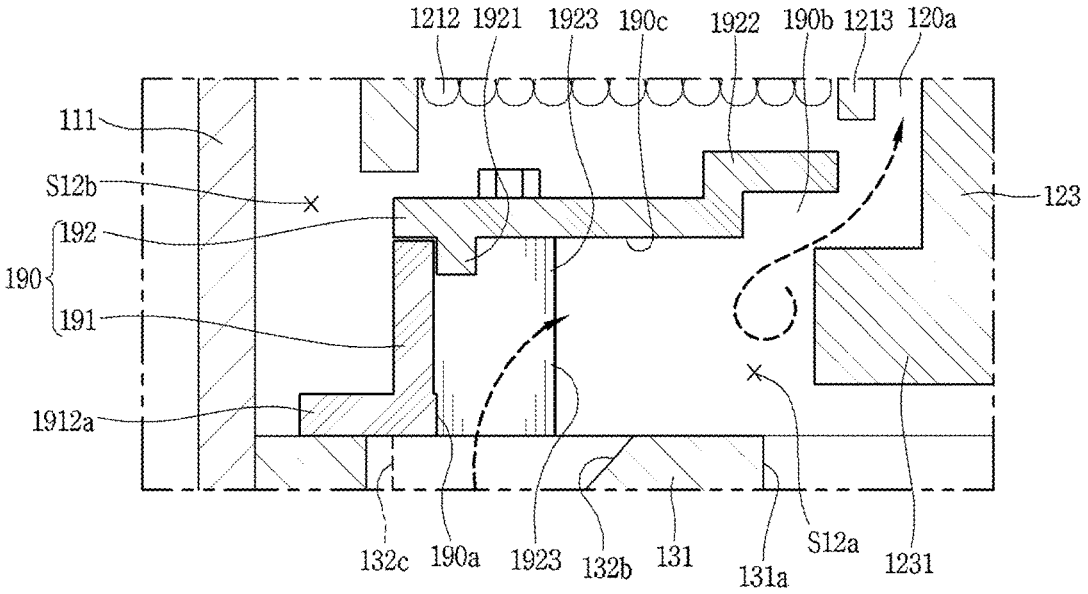
Figure 15:
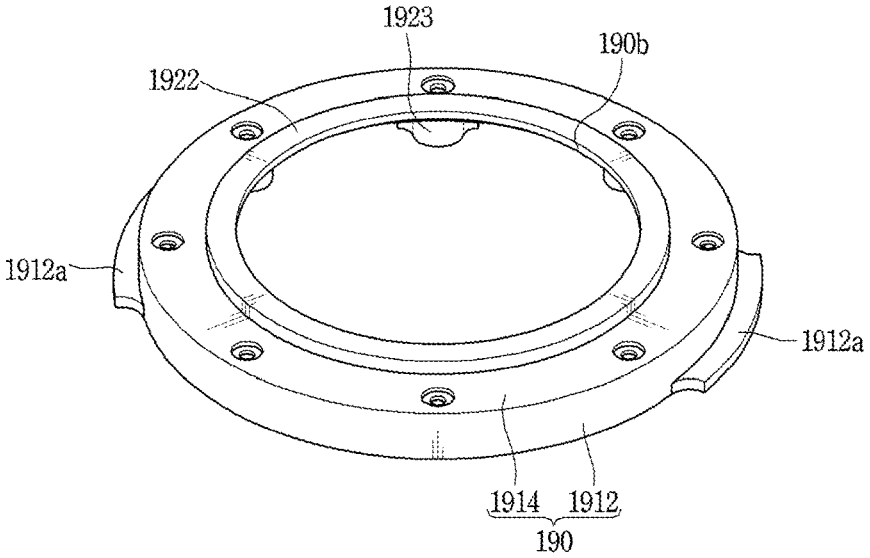
FIG. 15 is an exploded perspective view and FIG. 16 is an assembled sectional view illustrating still another embodiment of a flow path guide.
Figure 16:
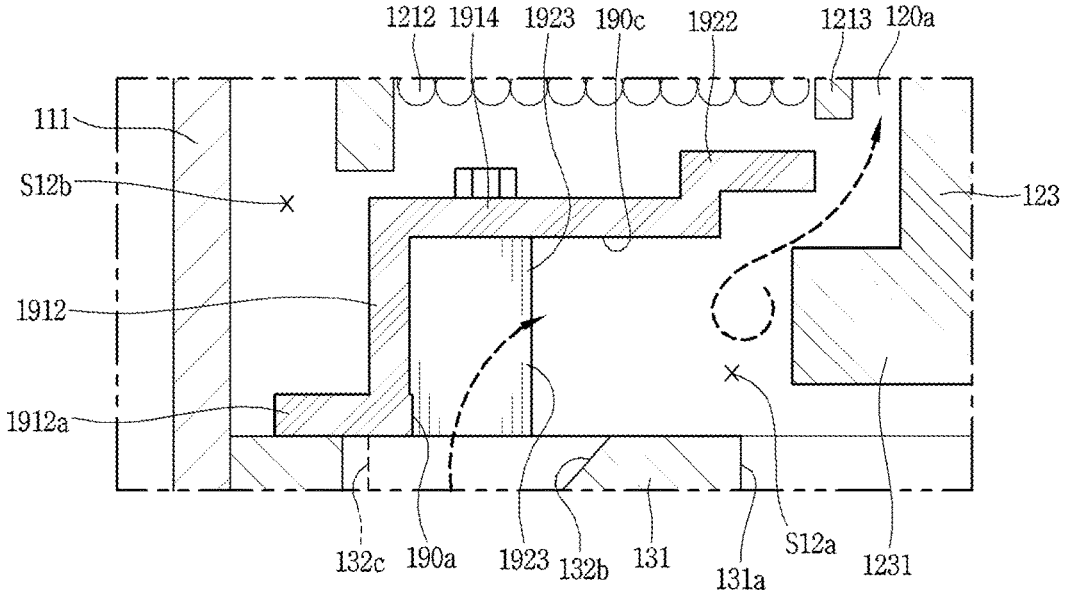

FIG. 13 is an exploded perspective view and FIG. 14 is an assembled sectional view illustrating still another embodiment of the flow path guide, and FIG. 15 is an exploded perspective view and FIG. 16 is an assembled sectional view illustrating still another embodiment of the flow path guide.

Referring to FIGS. 13 and 14, the flow path guide 190 according to this embodiment may include the lower plate guide 191 and the upper plate guide 192. Since the upper plate guide 192 is the same as that of the embodiment of FIG. 9, a description thereof will be replaced with the description of the above embodiment.

The lower plate guide 191 may include the outer wall portion 1912 without the bottom portion. Since the outer wall portion 1912 is the same as that of the embodiment of FIG. 9, a description thereof will be replaced with the description of the embodiment of the FIG. 9.

However, in this embodiment, as the bottom portion is excluded, the guide inlet 190*a* may not be formed through the lower plate guide 191 forming the flow path guide 190, but be formed such that the discharge guide groove 132*b* is exposed to an inner side of an inner side surface of the outer wall portion 1912 forming the lower plate guide 181. In other words, the guide inlet 190*a* may be formed by an inner circumferential surface of the outer wall portion 1912. Accordingly, since there is no need to separately form the guide inlet 190*a* in the lower plate guide 191, a manufacturing cost for the lower plate guide 191 may be reduced.

In addition, in this embodiment, as the bottom portion is excluded, the inner circumferential end of the upper plate guide 192 and the upper surface of the main frame 130 are opened to form the guide outlet 190*b*. Accordingly, an area of the guide outlet 190*b* may be increased.

When the bottom portion is excluded from the lower plate guide 191 forming the flow path guide 190 as described above, the manufacturing cost for the lower plate guide 191 may be lowered and the area of the guide outlet 190*b* may be increased.

In addition, when the bottom portion is excluded from the lower plate guide 191, an entire cross-section of the flow path guide 190 may be defined in "¬" shape as illustrated in FIG. 14. Here, the flow path guide 190 may be formed such that the lower plate guide 191 and the upper plate guide 192 are integrally extended as illustrated in FIG. 16. In this case, the lower plate guide 191 may be understood as the outer wall portion 1912 and the upper plate guide 192 may be understood as a blocking portion.

Specifically, the flow path guide 190 according to the embodiment of FIGS. 15 and 16 may include the outer wall portion 1912 and a blocking portion 1914 integrally extending from a motor portion-side end portion of the outer wall portion 1912 toward the rotation shaft 125.

The guide inlet 190*a* may be formed such that the discharge guide groove 132*b* is opened at the inner side of the outer wall portion 1912 as in the embodiment of FIG, and the guide outlet 190*b* may be formed to be spaced apart from the upper surface of the main frame 130.

However, even in this case, a support rib 1915 integrally extending from a lower surface of the blocking portion 1914 or from the inner circumferential surface of the outer wall portion 1912 may be formed in the same manner as in the above-described embodiments.

When the bottom portion 1911 is excluded from the lower plate guide 191 as described above, the outer wall portion 1912 forming the lower plate guide 191 and the blocking portion 1914 forming the upper plate guide 192 may be integrally formed. This may allow the flow path guide 190 to be manufactured in one process, thereby making it easy to manufacture the flow path guide 190, and thus a manufacturing cost of the flow path guide 190 can be reduced. In addition, since a process of assembling the upper plate guide 192 to the lower plate guide 191 may be eliminated, a manufacturing cost of the compressor can be reduced.

Hereinafter, description will be given of another embodiment of the flow path guide according to this embodiment.

In the above-described embodiment, the guide outlet of the flow path guide is spaced apart from the motor portion, but in some cases, the guide outlet of the flow path guide may be coupled to or almost in contact with the motor portion.

Figure 17:
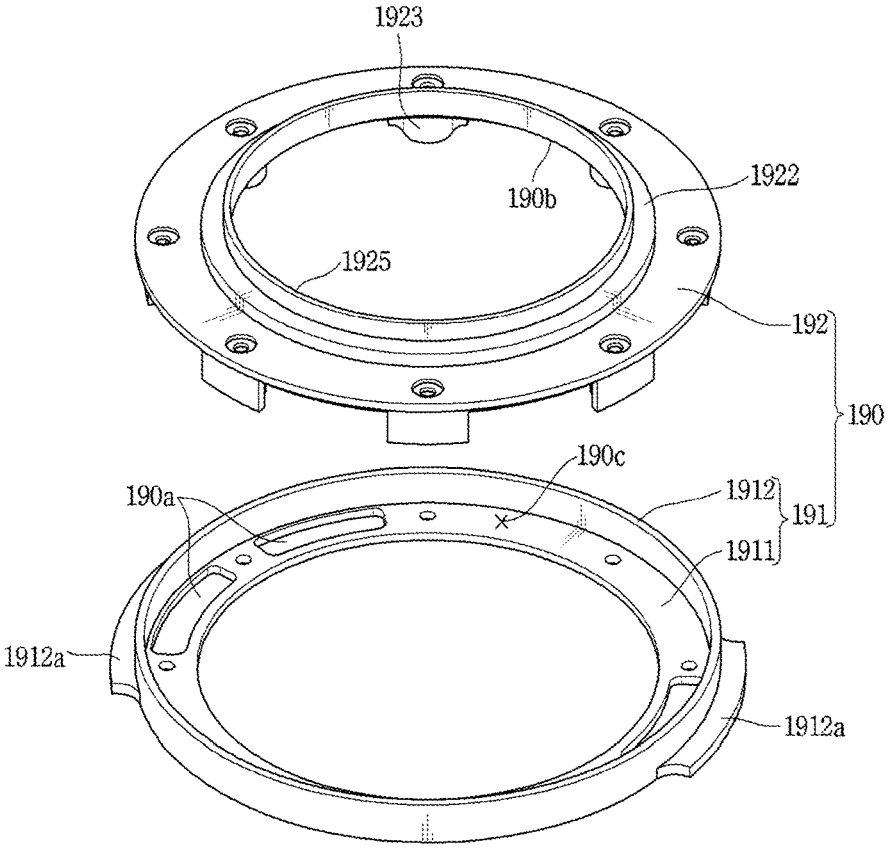
FIG. 17 is an exploded perspective view and FIG. 18 is an assembled sectional view illustrating still another embodiment of a flow path guide.
Figure 18:
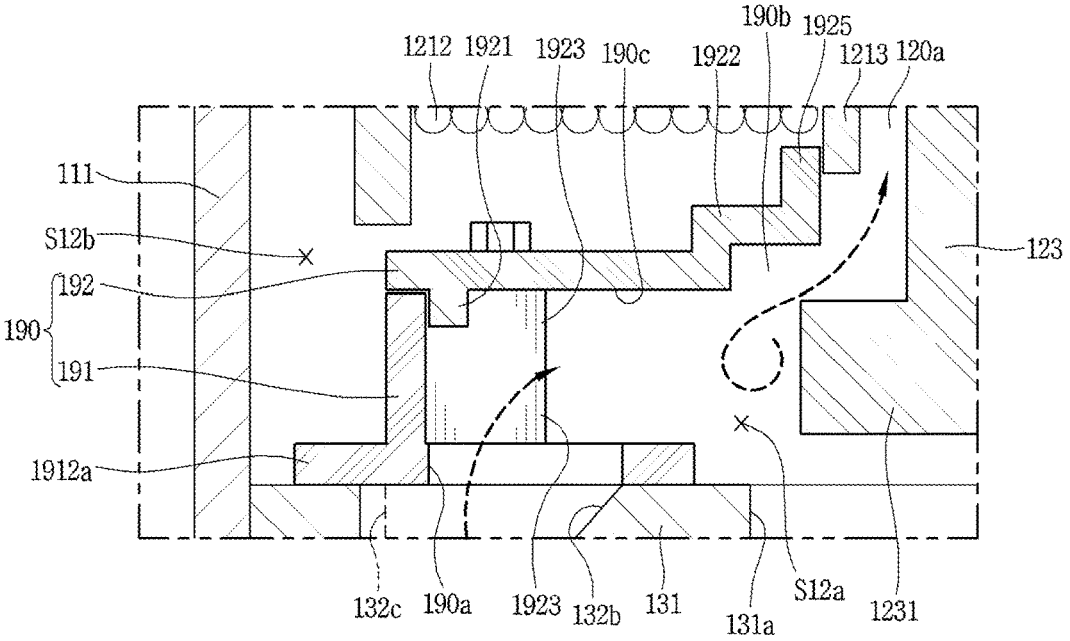

FIG. 17 is an exploded perspective view and FIG. 18 is an assembled sectional view illustrating still another embodiment of the flow path guide.

Referring to FIGS. 17 and 18, the flow path guide 190 according to this embodiment may include the lower plate guide 191 and the upper plate guide 192. Since the lower plate guide 191 is the same as that of the embodiment of FIG. 9, a description thereof will be replaced with the description of the above embodiment.

The upper plate guide 192 is generally similar to the embodiment of FIG. 9 described above. The upper plate guide 192 according to this embodiment may be provided with the guide outlet 190*b* forming an outlet of the flow path guide 190 at the inner circumferential end of the upper plate guide 192, and the guide outlet 190*b* may be bent upwardly to be opened toward the driving motor 120.

For example, the inner circumferential end of the upper plate guide 192 may be provided with the weight accommodating portion 1922 bent twice to form a step, and an end of the weight accommodating portion 1922 may be provided with an outlet extending portion 1925 bent once to form a step.

The weight accommodating portion 1922 may be opened in the radial direction to accommodate the balance weight 123 located at a central side, whereas the outlet extending portion 1925 may be bent in the axial direction to face the driving motor 120 located at the upper side, specifically, the air gap 120*a*.

As described above, as the outlet extending portion 1925 extending from the inner circumferential end of the upper plate guide 192 is bent upwardly toward the air gap 120*a* of the driving motor, most of refrigerant discharged to the discharge space S12 may be guided toward the air gap 120*a* rather than moving toward the inner passage formed by the slits of the stator core 1211.

In other words, when the outlet extending portion 1925 is not provided at the guide outlet 190*b* side, a part of the refrigerant discharged to the discharge space S12 may be pushed toward the inner circumferential surface of the casing 110 through a gap between the stator 121 and the upper plate guide (or blocking portion) 192. However, as the outlet extending portion 1925 is formed to extend in the axial direction at an end portion of the guide outlet 190*b* as in this embodiment, the refrigerant discharged to the discharge space S12 is trapped in the inner side space S12*a* by the outlet extending portion 1925 of the upper plate guide 192. Then, most of the refrigerant trapped in the inner side space S12*a* is introduced into the air gap 120*a* to move to the upper space.

In addition, when the guide outlet 190*b* is opened in the axial direction, that is, when the outlet extending portion 1925 is bent to extend toward the air gap 120*a*, an end of the outlet extending portion 1925 may overlap the insulator 1213, which is an insulating member, in the radial direction.

Specifically, at the stator core 1211 of the driving motor 120 according to this embodiment, the insulator 1213, which is an insulating member, is inserted between the stator core 1211 and the stator coil 1212.

The insulator 1213 may be provided at an outer circumferential side and an inner circumferential side with the stator coil 1212 interposed therebetween to extend therefrom in the axial direction from both ends of the stator core 1211 in the axial direction. Accordingly, the outlet extending portion 1925 of the upper plate guide 192 may extend in the axial direction to overlap an inner circumferential end of the lower insulator 1213 in the radial direction.

Accordingly, the discharge space S12 is partitioned in the radial direction by the outlet extending portion 1925 and the insulator 1213 at an inner circumferential side, so that the discharge space S12 is divided into the inner side space S12*a* and the outer side space S12*b*. In other words, the discharge space S12 is divided into the inner space S12*a* having the air gap 120*a* and the outer side space S12*b* having the stator coil (particularly, a slit) 1212.

Then, refrigerant discharged to the inner side space S12*a* of the discharge space S12 or refrigerant stirred by the balance weight 123 in the discharge space S12 is almost completely trapped by the insulator 1213 at the inner circumferential side and blocked from moving to the outer side space S12*b*, and the refrigerant eventually moves toward the air gap 120*a*, which is the only passage. Accordingly, most of the refrigerant discharged from the compression portion to the discharge space S12 passes through the air gap 120*a* of the driving motor 120 and the oil separation effect is improved by a strong centrifugal force in the upper space S2 as described above, and therefore, oil can be effectively separated from liquid refrigerant or gas refrigerant.

This may enhance the oil separation effect in the inner space 110*a* of the casing 110 to thereby reduce a volume of the upper space S2, which may be advantageous for miniaturization of the compressor.

Hereinafter, description will be given of another embodiment of the flow path guide according to this embodiment.

In the above-described embodiment, the inner side space and the outer side space are separated by the flow path guide interposed therebetween, but in some cases, the inner side space formed at the inner circumferential side of the flow path guide and the outer side space formed at an outer circumferential side of the flow path guide may communicate with each other.

Figure 19:
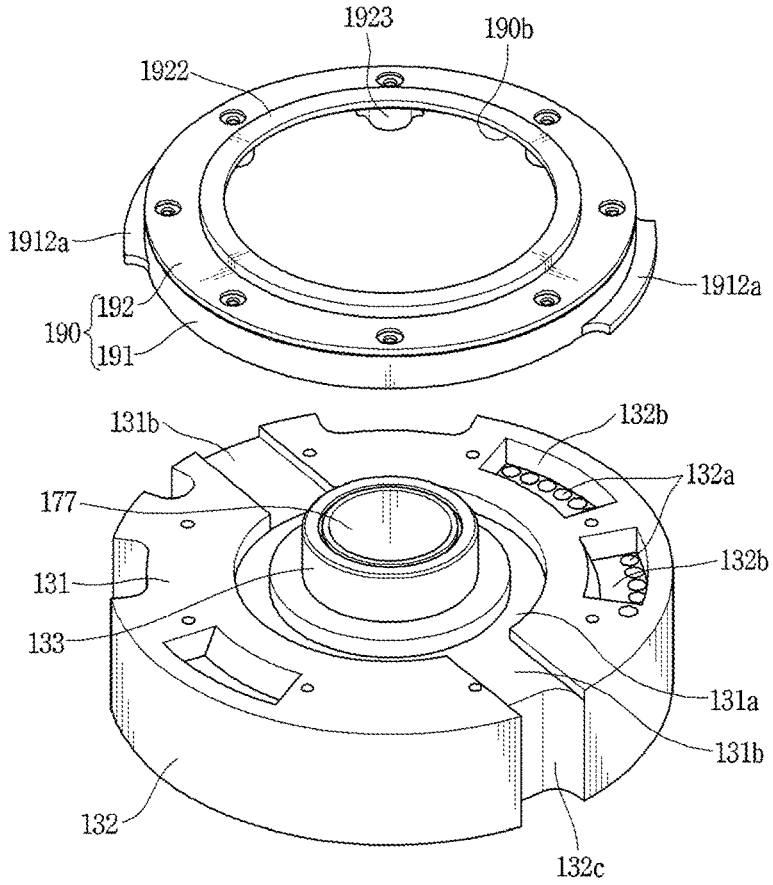
FIG. 19 is an exploded perspective view and FIG. 20 is an assembled sectional view illustrating still another embodiment of a flow path guide.
Figure 20:
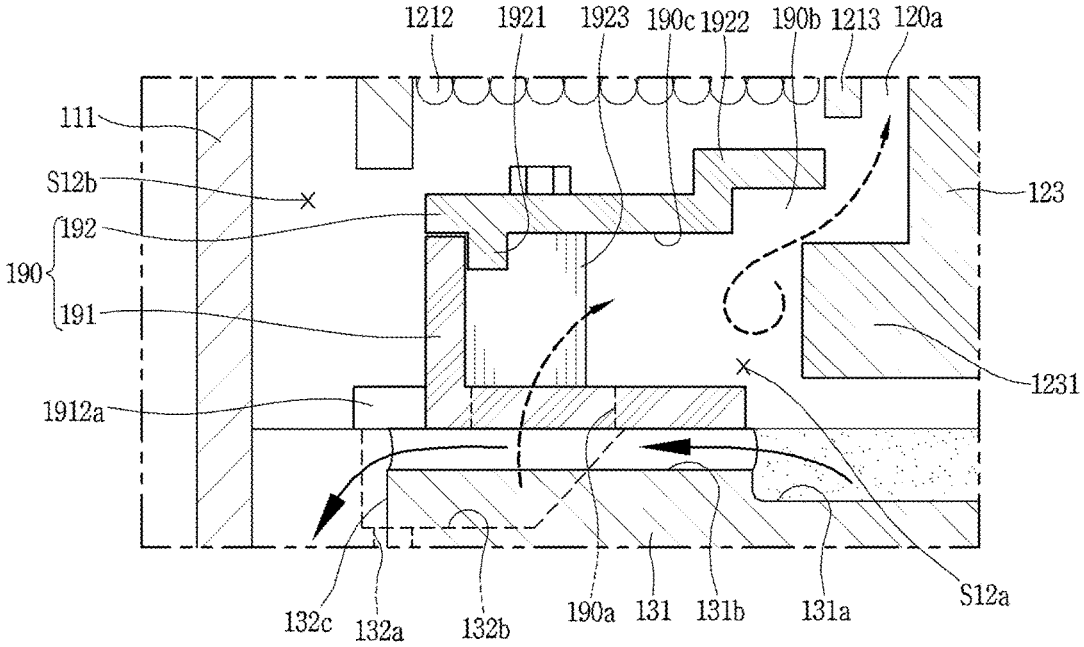
Figure 21:
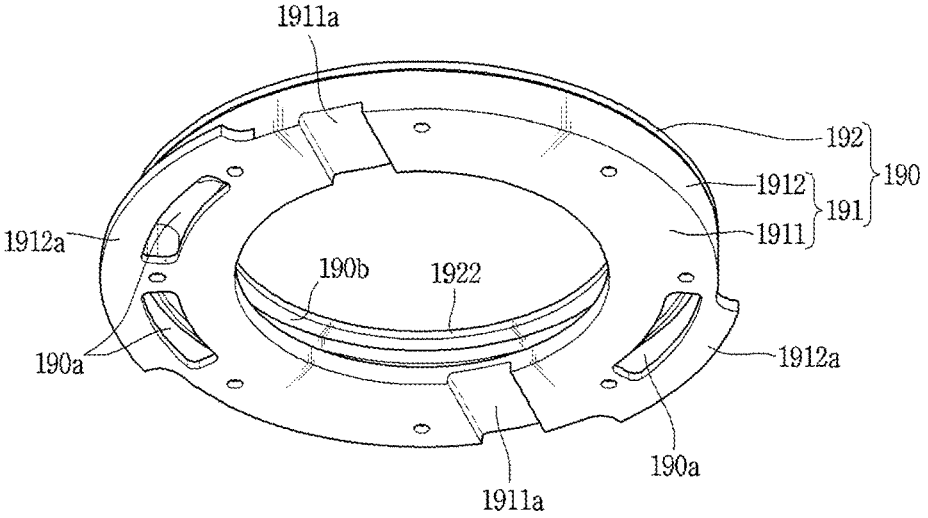
FIG. 21 is a perspective view and FIG. 22 is an assembled sectional view illustrating still another embodiment of a flow path guide.
Figure 22:
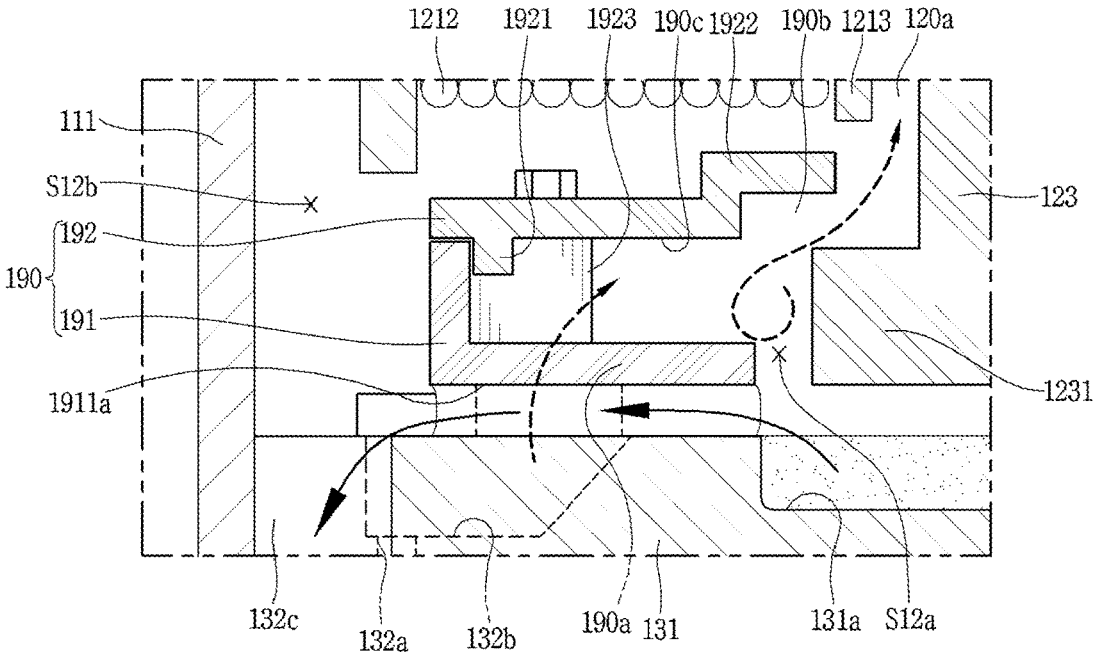

FIG. 19 is an exploded perspective view and FIG. 20 is an assembled sectional view illustrating still another embodiment of the flow path guide, and FIG. 21 is a perspective view and FIG. 22 is an assembled sectional view illustrating still another embodiment of the flow path guide.

Referring to FIGS. 19 and 20, the flow path guide 190 according to this embodiment may be formed in a same manner as the flow path guide 190 of the above-described embodiments. However, a bottom surface of the bottom portion forming the lower plate guide 191 of the flow path guide 190 may be partially spaced apart from the upper surface of the main frame 130 facing the bottom surface.

For example, an oil communication groove 131*b* forming the third recovery passage may be formed on the upper surface of the main frame 130. The oil communication groove 131*b* may be understood as an oil recovery groove.

The oil communication groove 131*b* is formed in a radial direction, one end thereof may communicate with the oil receiving groove 131*a* provided on the upper surface of the main frame 130 at the inner side of the flow path guide 190, and another end thereof may communicate with the first oil recovery groove 132*c* provided on the outer circumferential surface of the main frame 130.

The oil communication groove 131*b* may be located at a position not overlapping the guide inlet 190*a* provided in the bottom portion 1911 of the flow path guide 190, that is, a position between the guide inlets 190*a*. This structure may suppress refrigerant that has already been introduced into the inner space of the flow path guide 190, namely, the guide passage 190*c*, from leaking through the guide inlet 190*a* and the oil communication groove 131*b*.

When the oil communication groove 131*b* is formed on the upper surface of the main frame 130 as described above, oil separated from liquid refrigerant or gas refrigerant at the inner circumferential side of the flow path guide 190 may move to the storage space S11 of the casing 110 through the oil communication groove 131*b*. This may prevent liquid refrigerant or oil from remaining in the inner side space S12*a* formed at the inner circumferential side of the flow path guide 190, thereby preventing the liquid refrigerant or oil from being mixed again in the refrigerant discharged to the discharge space S12.

This may be more effective when the inner wall portion 1913 is formed in the flow path guide 190 illustrated in the embodiment of FIG. 12. Due to the inner wall portion 1913, liquid refrigerant or oil may not be introduced into the guide passage 190*c*, which is the inner space of the flow path guide 190. And, a large amount of liquid refrigerant or oil remaining in the inner side space S12*a* formed at the inner circumferential side of the flow path guide 190 is quickly moved to the first oil recovery groove 132*c* through the oil communication groove 131*b*, and then recovered in the storage space S11. Accordingly, liquid refrigerant or oil is prevented from being remained in the inner side space S12*a* formed at the inner circumferential side of the flow path guide 190, so as to be prevented from being mixed again in the refrigerant being discharged.

As illustrated in FIGS. 21 and 22, the oil communication groove 1911*a* forming the third recovery passage may be formed on the lower surface of the flow path guide 190. For example, the bottom portion 1911 of the lower plate guide 191 may be provided with the oil communication groove 1911*a* recessed or bent upwardly.

The oil communication groove 1911*a* may be formed such that both ends thereof are opened in the radial direction in the bottom portion 1911 of the lower plate guide 191. Accordingly, an inner circumferential side of the oil communication groove 1911*a* may communicate with the oil receiving groove 131*a* provided on the upper surface of the main frame 130, and an outer circumferential side of the oil communication groove 1911*a* may communicate with the first oil recovery groove 132*c* provided on the outer circumferential surface of the main frame 130.

Even when the oil communication groove 1911*a* is formed on the lower plate guide 191 of the flow path guide 190 as described above, an effect resulting therefrom is similar to a case where the oil communication groove 131*b* is provided in the main frame 130. However, in this case, since the oil communication groove 1911*a* is provided in the flow path guide 190, which is relatively easily formed, a manufacturing process for the oil communication groove may be simplified.

Hereinafter, description will be given of still another embodiment of the flow path guide.

In the above-described embodiment, the discharge guide groove is formed on the upper surface of the main frame, but in some cases, the discharge guide groove is excluded and a discharge hole may be formed to be bent up to a position adjacent to the rotation shaft.

Figure 23:
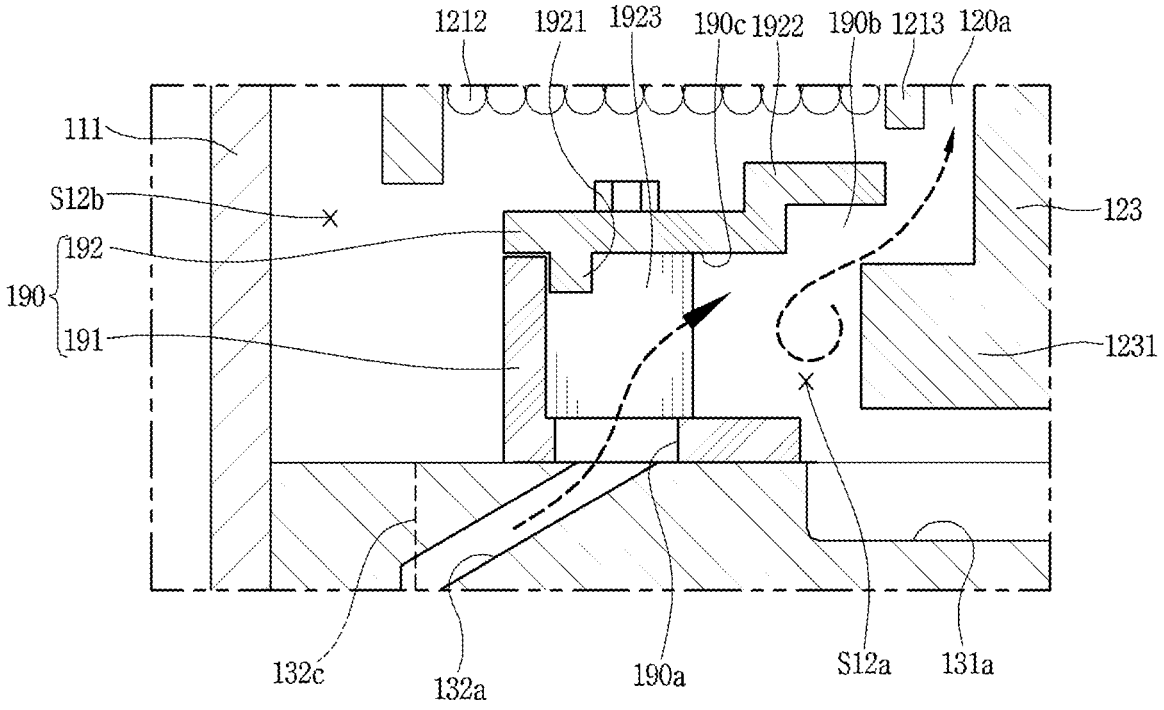
FIG. 23 is a sectional view illustrating another embodiment of a discharge passage and a flow path guide in FIG. 2.

FIG. 23 is a sectional view illustrating another embodiment of the discharge passage and the flow path guide in FIG. 2.

Referring to FIG. 23, the main frame 130 according to this embodiment may be provided with the aforementioned second discharge hole 132*a*. A lower end portion of the second discharge hole 132*a* may be formed in the axial direction, and an upper end portion may be formed to be inclined toward the rotation shaft 125.

Accordingly, the flow path guide 190 may be installed at a position closer to the rotation shaft 125 compared to the above-described embodiments. Here, the flow path guide 190 may be defined in "E" cross-sectional shape as illustrated in FIG. 23, or may be defined in "L" cross-sectional shape, although not illustrated in the drawing.

In other words, in this case, the flow path guide 190 does not need to have a separate discharge passage cover portion at the outer circumferential surface of the outer wall portion 1912 forming a part of the lower plate guide 191. Accordingly, a structure of the flow path guide 190 is simplified, and therefore, the flow path guide 190 is easily manufactured.

Meanwhile, in the above-described embodiments, the outer circumferential surface of the balance weight is formed flat, but in some cases, the outer circumferential surface of the balance weight may be formed unevenly.

Figure 24:
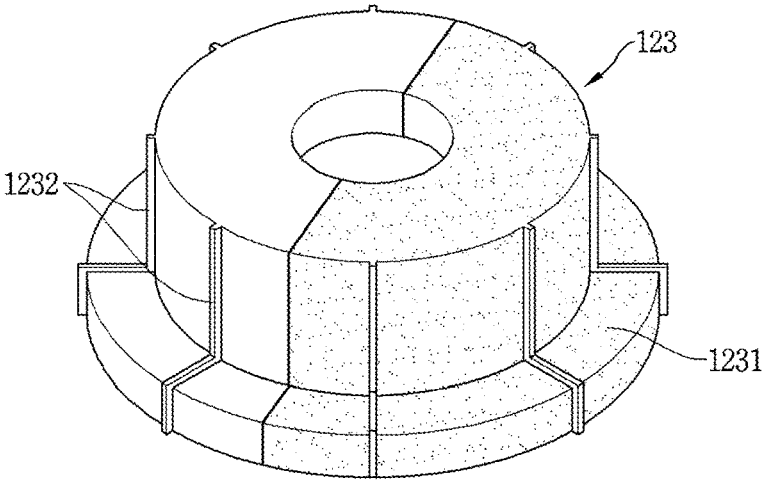
FIG. 24 is a perspective view and FIG. 25 is a sectional view illustrating another embodiment of a balance weight.
Figure 25:
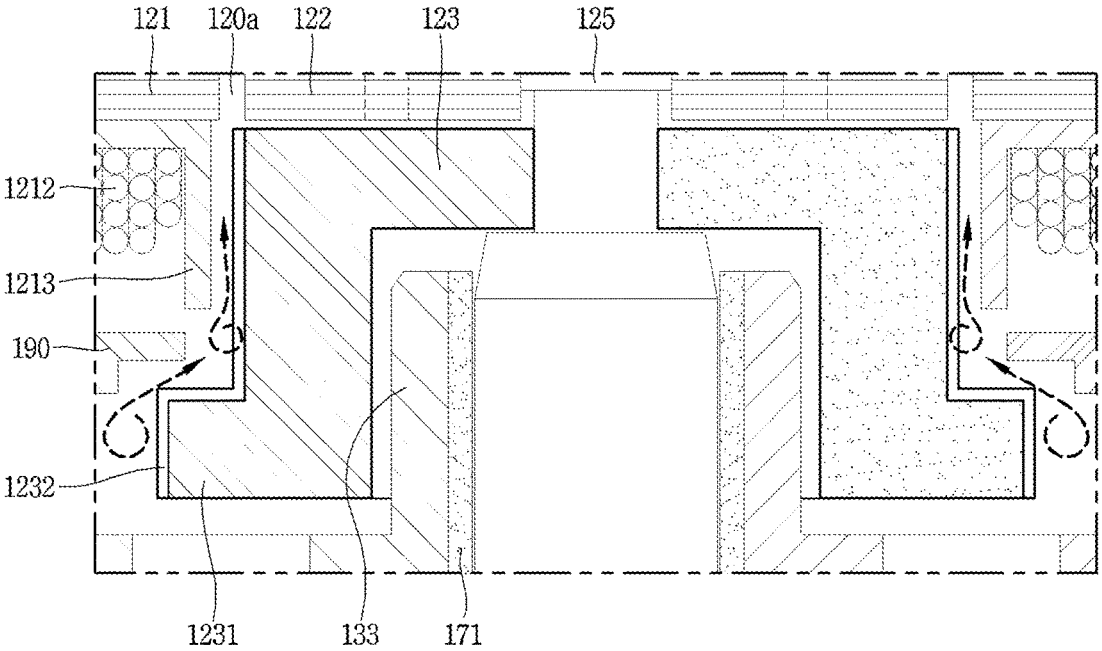
Figure 26:
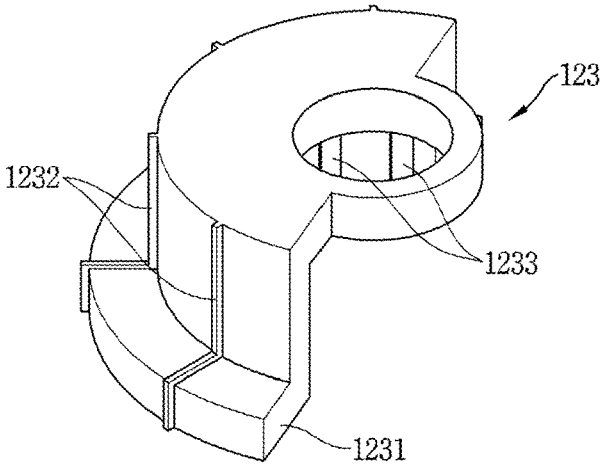
FIG. 26 is a perspective view and FIG. 27 is a sectional view illustrating still another embodiment of a balance weight.
Figure 27:
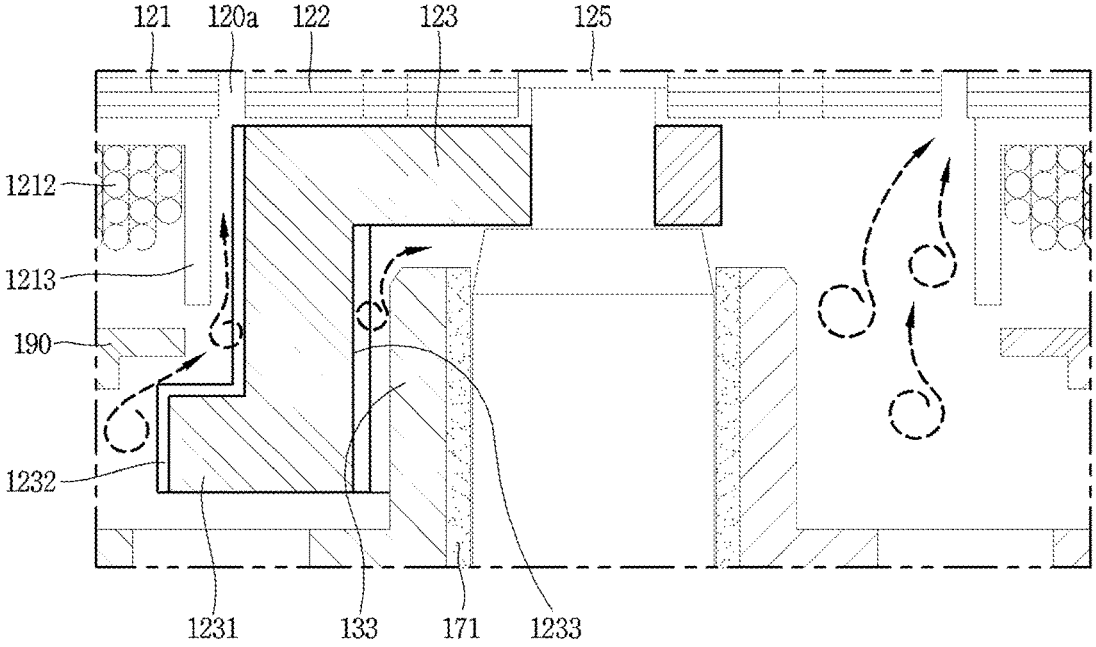

FIG. 24 is a perspective view and FIG. 25 is a sectional view illustrating another embodiment of the balance weight. FIG. 26 is a perspective view and FIG. 27 is a sectional view illustrating still another embodiment of the balance weight.

Referring to FIGS. 24 and 25, the balance weight 123 according to this embodiment is defined in a cylindrical shape, but one side thereof in the circumferential direction may be made of a relatively heavy material, whereas another side thereof in the circumferential direction may be made of a relatively light material.

The outer circumferential surface of the balance weight 123 may be provided with at least one stirring protrusion 1232. The stirring protrusion 1232 extends in the axial direction, and in some cases, may be formed in an oblique direction or in a helical direction.

When the stirring protrusion 1232 is formed in an oblique direction or a helical direction, it may be preferable that the stirring protrusion 1232 is formed in a forward direction with respect to a rotation direction of the balance weight 123.

The stirring protrusion 1232 may be formed on the entire outer circumferential surface of the balance weight 123, or may be formed only partially. For example, when the stirring protrusion 1232 is formed on the inner wall portion 1913 of the lower plate guide 191 of the flow path guide 190, the stirring protrusion 1232 may be formed only on a portion not covered by the inner wall portion 1913, that is, a portion not overlapping the inner wall portion 1913 in the axial direction, in consideration of a distance between the flow path guide 190 and the balance weight 123.

Although not illustrated in the drawing, in addition to the stirring protrusion, a stirring groove may be formed on the outer circumferential surface of the balance weight 123.

In addition, as illustrated in FIGS. 26 and 27, the balance weight 123 may be defined in a semi-cylindrical shape. Here, the outer circumferential surface of the balance weight 123*a* may be provided with the stirring protrusion 1232 and the inner circumferential surface of the balance weight 123*a* may be provided with the stirring groove 1233. Although not illustrated in the drawings, the outer circumferential surface and the inner circumferential surface of the balance weight 123*a* both may be provided with either the stirring protrusion 1232 or the stirring groove 1233.

The stirring protrusion 1232 or the stirring groove 1233 may be formed not only on the outer circumferential surface of the balance weight 123 but also on the inner circumferential surface of the balance weight 123. Even in this case, the stirring protrusion 1232 or the stirring groove 1233 of the balance weight 123 may be formed in the axial direction, or may be formed in the oblique direction or the helical direction.

When the stirring protrusion 1232 or the stirring groove 1233 is formed on each of the outer circumferential surface and the inner circumferential surface of the balance weight 123 as described above, not only refrigerant outside the balance weight 123 but also refrigerant introduced into the balance weight may be stirred. Accordingly, liquid refrigerant or oil may be effectively separated from the refrigerant discharged to the discharge space S12 by the flow path guide 190.

In particular, when the balance weight 123 is defined in a semi-cylindrical shape, both end portions of the balance weight 123 in the circumferential direction may serve as a stirring protrusion, thereby further enhancing a stirring effect for refrigerant.

Meanwhile, in the above-described embodiments, the outer circumferential surface of the rotor or the inner circumferential surface of the stator facing the outer circumferential surface of the rotor is defined in a shape of a smooth tube, but in some cases, the outer circumferential surface of the rotor or the inner circumferential surface of the stator may be formed unevenly.

Figure 28:
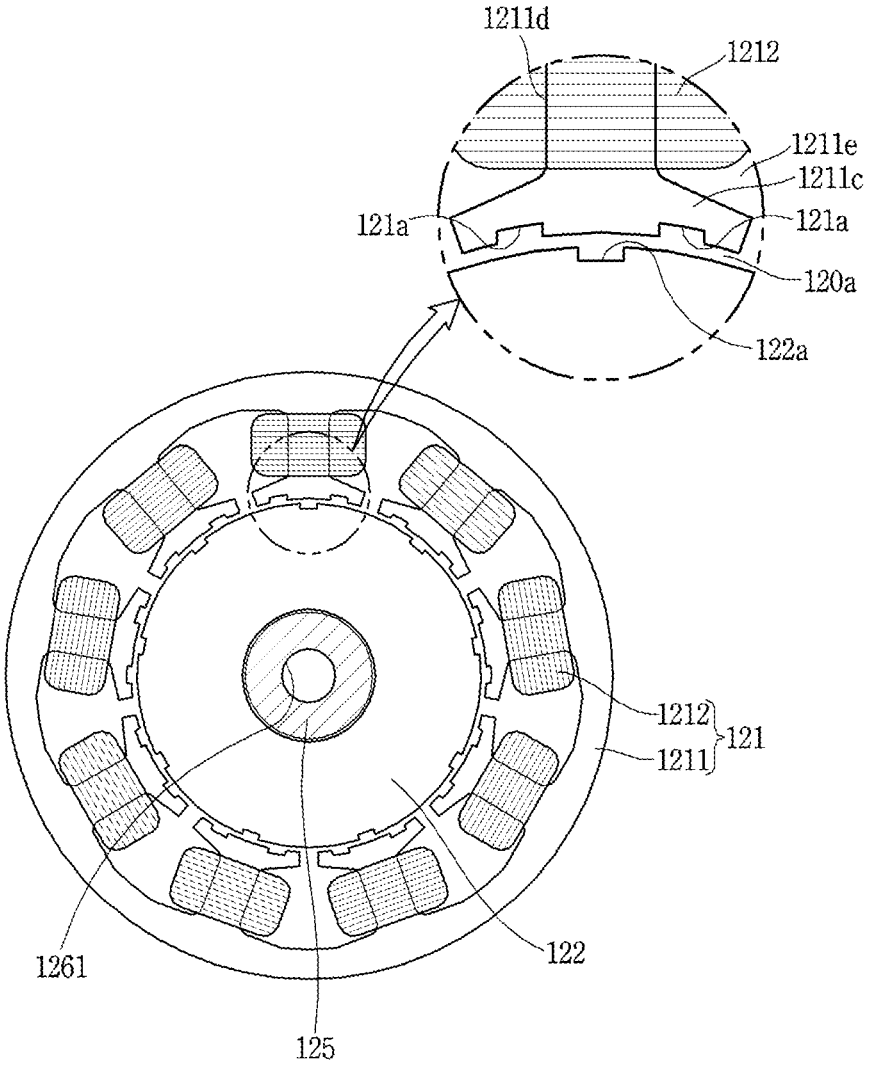
FIG. 28 is a planar view illustrating another embodiment of a driving motor.

FIG. 28 is a planar view illustrating another embodiment of the driving motor.

Referring to FIG. 28, the inner circumferential surface of the stator 121 may be provided with at least one stirring groove 121*a* and 122*a*, and the outer circumferential surface of the rotor 122 may be provided with at least one stirring groove 122*a*. For example, the inner circumferential surface of the stator 121 may be provided with a first stirring groove 121*a*, and outer circumferential surface of the rotor 122 facing the stator 121 may be provided with a second stirring groove 122*a*.

The first stirring groove 121*a* may pass through both ends of the stator 121 in the axial direction, and the second stirring groove 122*a* may pass through both ends of the rotor 122 in the axial direction.

The first stirring groove 121*a* and the second stirring groove 122*a* each may be formed in a same direction or a shape same as each other, or may be formed in different directions or shapes. For example, the first stirring groove 121*a* and the second stirring groove 122*a* may be formed in the axial direction. However, in some cases, the first stirring groove 121*a* may be formed in the oblique direction or the helical direction, and the second stirring groove 122*a* may be formed in the axial direction, or they may be formed vice versa.

In addition, the first stirring grooves 121*a* may be spaced apart from each other in the circumferential direction with a center of a pole portion 1211*c* interposed there between. In other words, the first stirring grooves 121*a* each may be formed at a portion not overlapping teeth 1211*d* in the radial direction but overlapping a slit 1211*e* in the radial direction.

A circumferential width of the second stirring groove 122*a* may be smaller than or equal to a width of the teeth of the stator 121. Accordingly, while the stirring grooves 121*a* and 122*a* are respectively formed on the inner circumferential surface of the stator 121 and the outer circumferential surface of the rotor 122, a decrease in motor efficiency may be effectively suppressed.

When the inner circumferential surface of the stator 121 provided with the stirring groove 121*a* and the outer circumferential surface of the rotor 122 facing the same and provided with the stirring groove 122*a* form the air gap 120*a*, refrigerant passing through the air gap 120*a* is stirred to be discharged to the upper space S2 to thereby increase a centrifugal force of the refrigerant, the oil separation effect in the upper space S2 can be improved.

Here, when the first stirring groove 121*a* and the second stirring groove 122*a* are formed in the same direction, a centrifugal force of the refrigerant passing through the air gap 120*a* may be increased, and when the first stirring groove 121*a* and the second stirring groove 122*a* are formed in different directions, a stirring effect in air gap 120*a* may be doubled.

Although the foregoing description has been given with reference to the preferred embodiment, it will be understood that those skilled in the art will be able to variously modify and change the present disclosure without departing from the scope of the disclosure described in the claims below.

What is claimed is:

1. A scroll compressor comprising:

a casing defining an inner space;

a motor including (i) a stator that is fixed in the inner space of the casing and defines a first recovery passage extending between opposite ends of the stator in an axial direction, and (ii) a rotor that is configured to rotate relative to the stator, wherein a gap is defined between the rotor and the stator;

a compression portion fixed in the inner space of the casing and including a plurality of scrolls, the compression portion defining a discharge passage that is configured to discharge refrigerant compressed by a motion of the plurality of scrolls relative to the inner space of the casing, wherein the discharge passage extends radially with respect to the gap between the rotor and the stator;

a rotation shaft configured to be rotated by the motor and drive the compression portion; and a flow path guide positioned at a discharge space between the motor and the compression portion and including a guide outlet that is in fluid communication with the discharge space and opened in a direction toward the rotation shaft, wherein a second surface of the compression portion faces the motor and defines a discharge guide groove configured to accommodate the discharge passage, wherein the flow path guide extends between an outer circumferential surface and an inner circumferential surface of the discharge guide groove in a circumferential direction, wherein the flow path guide comprises:

an outer wall portion defined in an annular shape and extending in a direction toward the motor from the compression portion, and a blocking portion defined in an annular shape and extending in a direction toward the rotation shaft from a first end portion of the outer wall portion, and wherein an inner circumferential-side end portion of the blocking portion is spaced apart from the second surface of the compression portion facing the motor to thereby define the guide outlet.

2. The scroll compressor of claim 1, wherein the flow path guide includes a guide inlet that is radially spaced apart from the guide outlet and in fluid communication with the discharge passage, and wherein the guide outlet is disposed closer to the rotation shaft than the guide inlet is to the rotation shaft.

3. The scroll compressor of claim 1, wherein a balance weight is positioned at the rotation shaft or at the rotor, and located at the discharge space, and wherein the guide outlet is located at a position overlapping an outer circumferential surface of the balance weight.

4. The scroll compressor of claim 1, wherein the stator includes a stator core and a stator coil wound around the stator core, wherein an insulating member is positioned between the stator core and the stator coil, and wherein at least a portion of the guide outlet overlaps the insulating member at an inner circumferential side of the stator coil.

5. The scroll compressor of claim 1, wherein the flow path guide includes (i) a guide inlet that is radially spaced apart from the guide outlet and in fluid communication with the discharge passage, and (ii) a guide passage that provides fluid communication between the guide inlet and the guide outlet, and wherein an inner circumferential surface of the guide passage defines a guide surface inclined or curved toward the guide outlet.

6. The scroll compressor of claim 1, wherein a lower surface of the flow path guide contacts with an upper surface of the compression portion that faces the lower surface of the flow path guide to thereby separate an inner side space from a second recovery passage, the inner side space being defined at an inner circumferential side of the flow path guide in the discharge space, and the second recovery passage being defined at an outer circumferential surface of the compression portion.

7. The scroll compressor of claim 1, wherein a third recovery passage is defined between a lower surface of the flow path guide and a first surface of the compression portion that faces the lower surface of the flow path guide to thereby allow an inner side space to be in fluid communication with a second recovery passage, the inner side space being defined at an inner circumferential side of the flow path guide in the discharge space, and the second recovery passage being defined at an outer circumferential surface of the compression portion, and wherein the third recovery passage is spaced apart in a circumferential direction from a guide inlet, the guide inlet defining an inlet of the flow path guide.

8. The scroll compressor of claim 7, wherein the first surface of the compression portion defines the inner side space at the inner circumferential side of the flow path guide and includes an oil receiving groove, wherein the oil receiving groove is in fluid communication with the third recovery passage, and wherein the third recovery passage is defined based on the first surface of the compression portion being recessed or on the lower surface of the flow path guide being recessed, the lower surface of the flow path guide facing the first surface of the compression portion.

9. The scroll compressor of claim 1, wherein the flow path guide further comprises a bottom portion extending in a radial direction toward the rotation shaft from a second end portion of the outer wall portion, and wherein the bottom portion includes a guide inlet that is in fluid communication with the discharge guide groove.

10. The scroll compressor of claim 9, wherein the flow path guide further comprises an inner wall portion extending in a direction from an inner circumferential side of the bottom portion toward the motor, and wherein the inner wall portion is positioned lower than the outer wall portion and spaced apart from the blocking portion to thereby define the guide outlet.

11. The scroll compressor of claim 1, wherein a balance weight is positioned at the rotation shaft or at the rotor, and located at the discharge space, and wherein at least one stirring protrusion or at least one stirring groove is defined at a circumferential surface of the balance weight.

12. The scroll compressor of claim 1, wherein at least one of an inner circumferential surface of the stator or an outer circumferential surface of the rotor defines a stirring groove that extends between opposite ends of the stator or the rotor in the axial direction.

13. The scroll compressor of claim 1, wherein the outer wall portion is coupled to the compression portion, and wherein the blocking portion extends toward the rotation shaft from an end portion of the outer wall portion.

14. The scroll compressor of claim 1, wherein the stator is defined in a cylindrical shape, wherein an inner circumferential surface of the stator includes a plurality of teeth defined in a circumferential direction with slits interposed therebetween, wherein a stator coil is wound around the teeth, and wherein the guide outlet is located closer to the rotation shaft than an inner circumferential surface of the stator coil is to the rotation shaft, or located at a same distance to the rotation shaft as the inner circumferential surface of the stator coil is to the rotation shaft.

15. A scroll compressor comprising:

a casing defining an inner space;

a motor including (i) a stator that is fixed in the inner space of the casing and defines a first recovery passage extending between opposite ends of the stator in an axial direction, and (ii) a rotor that is configured to rotate relative to the stator, wherein a gap is defined between the rotor and the stator;

a compression portion fixed in the inner space of the casing and including a plurality of scrolls, the compression portion defining a discharge passage that is configured to discharge refrigerant compressed by a motion of the plurality of scrolls relative to the inner space of the casing, wherein the discharge passage extends radially with respect to the gap between the rotor and the stator;

a rotation shaft configured to be rotated by the motor and drive the compression portion; and a flow path guide positioned at a discharge space between the motor and the compression portion and including a guide outlet that is in fluid communication with the discharge space and opened in a direction toward the rotation shaft, wherein the flow path guide comprises:

a lower plate guide coupled to the compression portion and including a guide inlet that is in fluid communication with the discharge passage; and an upper plate guide coupled to an upper end of the lower plate guide, wherein the guide outlet is in fluid communication with the gap between the stator and the rotor at a position closer to the rotation shaft than the guide inlet.

16. The scroll compressor of claim 15, wherein at least one of the lower plate guide or the upper plate guide includes an outer wall portion extending in the axial direction, and wherein an outer circumferential side of the lower plate guide and an outer circumferential side of the upper plate guide are sealed by the outer wall portion, and wherein an inner circumferential side of the lower plate guide and an inner circumferential side of the upper plate guide are spaced apart from each other to thereby define the guide outlet.

17. The scroll compressor of claim 16, wherein the inner circumferential side of the lower plate guide or the inner circumferential side of the upper plate guide includes an inner wall portion, and wherein the inner circumferential side of the upper plate guide or the inner circumferential side of the lower plate guide is spaced apart from the inner wall portion to thereby define the guide outlet.

18. An air conditioner comprising a scroll compressor, a condenser, an expander, and an evaporator, wherein the scroll compressor comprises:

a casing defining an inner space;

a motor including (i) a stator that is fixed in the inner space of the casing and defines a first recovery passage extending between opposite ends of the stator in an axial direction, and (ii) a rotor that is configured to rotate relative to the stator, wherein a gap is defined between the rotor and the stator;

a compression portion fixed to the inner space of the casing and including a plurality of scrolls, the compression portion defining a discharge passage that is configured to discharge refrigerant compressed by a motion of the plurality of scrolls relative to the inner space of the casing, wherein the discharge passage extends radially with respect to the gap between the rotor and the stator;

a rotation shaft configured to be rotated by the motor and drive the compression portion; and a flow path guide positioned at a discharge space between the motor and the compression portion and including a guide outlet that is in fluid communication with the discharge space and opened in a direction toward the rotation shaft, wherein a second surface of the compression portion faces the motor and defines a discharge guide groove configured to accommodate the discharge passage, wherein the flow path guide extends between an outer circumferential surface and an inner circumferential surface of the discharge guide groove in a circumferential direction, wherein the flow path guide comprises:

an outer wall portion defined in an annular shape and extending in a direction toward the motor from the compression portion, and a blocking portion defined in an annular shape and extending in a direction toward the rotation shaft from a first end portion of the outer wall portion, and wherein an inner circumferential-side end portion of the blocking portion is spaced apart from the second surface of the compression portion facing the motor to thereby define the guide outlet.

* * * * *